US007331410B2

(12) United States Patent
Yong et al.

(10) Patent No.: US 7,331,410 B2
(45) Date of Patent: Feb. 19, 2008

(54) DRILL BIT ARCUATE-SHAPED INSERTS WITH CUTTING EDGES AND METHOD OF MANUFACTURE

(75) Inventors: Zhou Yong, Spring, TX (US); Jim Minikus, Spring, TX (US); Armardeep Singh, Houston, TX (US); Quan Nguyen, Santa Ana, CA (US); Sharath Kolachalam, Houston, TX (US)

(73) Assignee: Smith International, Inc., Houston, TX (US)

( * ) Notice: Subject to any disclaimer, the term of this patent is extended or adjusted under 35 U.S.C. 154(b) by 183 days.

(21) Appl. No.: 10/923,653

(22) Filed: Aug. 20, 2004

(65) Prior Publication Data

US 2005/0077092 A1 Apr. 14, 2005

Related U.S. Application Data

(63) Continuation-in-part of application No. 10/189,966, filed on Jul. 3, 2002, now Pat. No. 6,823,951.

(51) Int. Cl.
*E21B 10/08* (2006.01)

(52) U.S. Cl. ..... 175/331; 175/373; 175/426; 76/108.4

(58) Field of Classification Search ..... 175/331, 175/373, 374, 377, 426; 76/108.4

See application file for complete search history.

(56) References Cited

U.S. PATENT DOCUMENTS

| | | | | |
|---|---|---|---|---|
| 3,223,188 A | | 12/1965 | Coulter, Jr. et al. | 175/374 |
| 3,599,737 A | * | 8/1971 | Fischer | 175/374 |
| 4,887,493 A | | 12/1989 | Drake | 76/5.1 |
| 4,951,762 A | | 8/1990 | Lundell | 175/410 |
| 5,341,890 A | | 8/1994 | Cawthorne et al. | 175/374 |
| 5,421,423 A | | 6/1995 | Huffstutler | 175/374 |
| 5,429,200 A | | 7/1995 | Blackman et al. | 175/371 |
| 5,452,771 A | | 9/1995 | Blackman et al. | 175/353 |
| 5,518,077 A | | 5/1996 | Blackman et al. | 175/353 |
| 5,644,956 A | | 7/1997 | Blackman et al. | 76/108.2 |
| 5,887,655 A | | 3/1999 | Haugen et al. | 166/298 |

(Continued)

FOREIGN PATENT DOCUMENTS

CA 2431200 1/2004

(Continued)

OTHER PUBLICATIONS

British Search Report dated Nov. 28, 2005, 1 pg.

*Primary Examiner*—Richard E. Chilcot, Jr.
*Assistant Examiner*—Matthew J. Smith
(74) *Attorney, Agent, or Firm*—Conley Rose, P.C.

(57) ABSTRACT

Disclosed are a variety of arcuate-shaped inserts for drill bits, and in particular, for placement in rolling cone cutters of drill bits. The arcuate inserts include 360° or ring-shaped inserts, as well as inserts of smaller arcuate length. The arcuate inserts are suitable for use in all surfaces of the rolling cone cutter, and in other locations in drill bits, and may have specialized cutting surfaces and material enhancements to enhance their cutting duty performance. Certain arcuate inserts may include stress relieving discontinuities such that, upon assembly into the cone or during drilling, the arcuate inserts may fragment in a controlled and predicted manner into shorter arcuate lengths.

35 Claims, 23 Drawing Sheets

U.S. PATENT DOCUMENTS

| | | | | |
|---|---|---|---|---|
| 5,887,668 | A | 3/1999 | Haugen et al. | 175/79 |
| 5,904,211 | A | 5/1999 | Friant et al. | 175/228 |
| 5,967,245 | A | 10/1999 | Garcia et al. | 175/374 |
| 6,119,797 | A | 9/2000 | Hong et al. | 175/336 |
| 6,202,752 | B1 | 3/2001 | Kuck et al. | 166/298 |
| 6,234,261 | B1 | 5/2001 | Evans et al. | 175/374 |
| 6,343,842 | B1 | 2/2002 | Sauer et al. | 299/79.1 |
| 6,823,951 | B2 * | 11/2004 | Yong et al. | 175/331 |

FOREIGN PATENT DOCUMENTS

| | | |
|---|---|---|
| GB | 2321265 | 7/1998 |
| GB | 2379682 | 3/2003 |
| GB | 2390384 | 1/2004 |

* cited by examiner

DRILL BIT ARCUATE-SHAPED INSERTS WITH CUTTING EDGES AND METHOD OF MANUFACTURE

This application is a Continuation-In-Part of U.S. patent application Ser. No. 10/189,966 filed Jul. 3, 2002 now U.S. Pat. No. 6,823,951 and entitled Arcuate-Shaped Inserts for Drill Bits.

STATEMENT REGARDING FEDERALLY SPONSORED RESEARCH OR DEVELOPMENT

Not applicable.

FIELD OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutter elements and in manufacturing techniques for cutter elements and rolling cone bits.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Rolling cone bits typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP. The form and positioning of the cutter elements (both steel teeth and tungsten carbide inserts) upon the cutters greatly impact bit durability and ROP and thus are critical to the success of a particular bit design.

The inserts in TCI bits are typically inserted in circumferential rows on the rolling cone cutters. Most such bits include a row of inserts in the heel surface of the rolling cone cutters. The heel surface is a generally frustoconical surface and is configured and positioned so as to align generally with and ream the sidewall of the borehole as the bit rotates. The heel inserts function primarily to maintain a constant gage and secondarily to prevent the erosion and abrasion of the heel surface of the rolling cone. Excessive wear of the heel inserts leads to an undergage borehole, loss of cone material that otherwise provides protection for seals, and further results in imbalance of loads on the bit that may cause premature failure of the bit.

In addition to the heel row inserts, conventional bits typically include a circumferential gage row of cutter elements mounted adjacent to the heel surface but orientated and sized in such a manner so as to cut the corner of the borehole. Conventional bits also include a number of additional rows of cutter elements that are located on the cones in circumferential rows disposed radially inward from the gage row. These cutter elements are sized and configured for cutting the bottom of the borehole and are typically described as inner row cutter elements.

One problem with conventional bit designs employing circumferential rows of spaced-apart inserts is that the discontinuous distribution of inserts allows severe wear to take place in the exposed region of the cone cutters between the individual inserts. Because the portion of the insert that is retained in the cone material is relatively small with conventional inserts having cylindrical bases, loss of adjacent cone material is a significant concern. This issue is particularly problematic in bits used in hard formations. As interstitial cone material is worn or eroded away from the regions between the inserts, the cone may lose its ability to absorb impact which, in turn, may lead to insert loss. Loss of inserts may both decrease ROP, and also lead to further erosion of the steel cone and loss of still additional inserts.

An additional design concern with TCI bits arises from the relatively small size of the heel row inserts. Generally, it would be desirable to include in the heel surface inserts having a relatively large diameter, and to provide the bit with a large number of such heel row inserts; however, the space available for inserts in the heel surface of the cone is severely limited due to the size and number of inserts placed in the gage row of the cone. The presence of the relatively large gage row inserts limits the size and the number of heel row inserts that can be retained in the adjacent heel surface. Because the heel row inserts on such conventional bits must therefore be relatively small in size and number, they do not offer the desired optimum protection against wear. In addition, the relatively small heel row inserts on conventional bits have other limitations: (a) they offer low strength against breakage/chipping caused by impact; (2) they must endure high contact stress while cutting formation material; (3) they possess relatively low capacity for heat dissipation. These factors contribute substantially to the failure modes of conventional rolling cone bits.

Accordingly, there remains a need in the art for a drill bit and cutting structure that are more durable than those conventionally known and that will retain inserts and cone material for longer periods so as to yield acceptable ROP's and an increase in the footage drilled while maintaining a full gage borehole.

SUMMARY OF THE PREFERRED EMBODIMENTS OF THE INVENTION

Preferred embodiments of the invention are disclosed that provide an earth boring bit having enhancements in cutter element design and in manufacturing techniques that provide the potential for increased bit life and footage drilled at full gage, as compared with similar bits of conventional technology. The embodiments disclosed include arcuate-shaped inserts of various arcuate lengths made through a conventional manufacturing process such as HIP. These inserts are disposed within a groove formed in the cone cutter of the rolling cone bit. Such inserts may also be placed in grooves formed elsewhere on the bit.

In certain embodiments, the arcuate-shaped inserts are disposed in an end-to-end relationship within the groove in the cone and substantially fill the cone groove. In other embodiments, the insert is a ring-shaped insert having a 360° arcuate length. In one aspect of the invention, inserts having 360° arcuate length are retained in a cone groove by interference fit, and the bit is made via a process in which the ring-shaped insert encircles the cone axis, is moved axially along the axis toward the cone groove, and press fit into the groove.

The inserts may include a plurality of spaced apart stress relief discontinuities, such as notches or grooves, such that, when the arcuate insert (including a full ring-shaped insert) is press fit within the cone groove, the insert is permitted to fragment at predetermined locations into a number of smaller, arcuate-shaped inserts. In certain embodiments, no such stress relief discontinuities are provided.

The arcuate inserts may be disposed in the back face, the heel surface or any other surface of the rolling cone cutter, including the general conical surface that retains inserts or other cutter elements that are employed in attacking the corner or the bottom of the borehole. Arcuate inserts, including full ring-shaped inserts, may be applied in multiple locations on the same cone cutter. Further, depending upon the cutting duty to be imposed on the inserts, as well as the expected formation material, the arcuate elements may have cutting surfaces configured in a variety of ways, including grooves having both positive and negative back rack, as well as intersecting grooves, that form cutting edges. Additionally, the cutting surfaces may have a variety of protrusions or recesses shaped to provide the cutting action desired.

The preferred embodiments disclosed contemplate the use of different materials to form the arcuate-shaped inserts or portions thereof. For example, the cutting surface may be made of a hard, wear resistant material, while the portion of the insert retained in the cone groove or channel may be made of a tougher material that is less likely to fracture than if it were made of the same hard, wear resistant material as the cutting surface. Similarly, the cutting surface may have different regions or segments made of different materials. For example, the radially outermost region of the cutting surface may be made of a harder more wear resistant material, while the innermost region is made of a tougher less brittle material.

Where employed, the stress relief discontinuities may include grooves of various cross sections, such as v-shaped or u-shaped, or square grooves. Such notches or grooves may be uni-directional, meaning extending in only a straight line, or they may be 3-dimensional in that they have portions extending in a first direction and portions that deviate from that first direction and extend into a different plane.

The embodiments disclosed further include a variety of features enhancing the inserts' ability to resist rotational movement within the cone groove, such features including non-circular inner surfaces or outer surfaces, tabs, concavities, edges or flats formed on the inner or outer surfaces of the arcuate-shaped inserts that engage similarly shaped features in the cone groove. Engaging pegs and corresponding recesses in the inserts and cone groove may also be employed.

Providing arcuate inserts in a groove about the entire cone or the major portion thereof, and manufacturing the inserts of extremely hard or durable materials as permitted by HIP technology, overcomes certain problems associated with conventional bits. Specifically, the arcuate inserts extending about the cone surface eliminates the areas in conventional bits between the cylindrical-based inserts that were vulnerable to erosion and premature wear. The bits and rolling cone cutters disclosed in the present application are intended to better protect the material between the extending protrusions of the cutting surface and to better protect against insert breakage and loss. Further, in the embodiments herein disclosed, the heat generated by the cutting surface is better able to be dissipated by virtue of the greater size of the arcuate insert as compared to the conventional, cylindrical-based inserts. This permits the arcuate inserts to retain their desirable material characteristics for a longer period of time whereas with conventional bits, the extreme heat could degrade or deteriorate the insert material. The bits, rolling cone cutters, and arcuate inserts described herein provide opportunities for greater improvement in cutter element life and thus bit durability and ROP potential. These and various other characteristics and advantages will be readily apparent to those skilled in the art upon reading the following detailed description of the preferred embodiments of the invention, and by referring to the accompanying drawings.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

Figure 1:
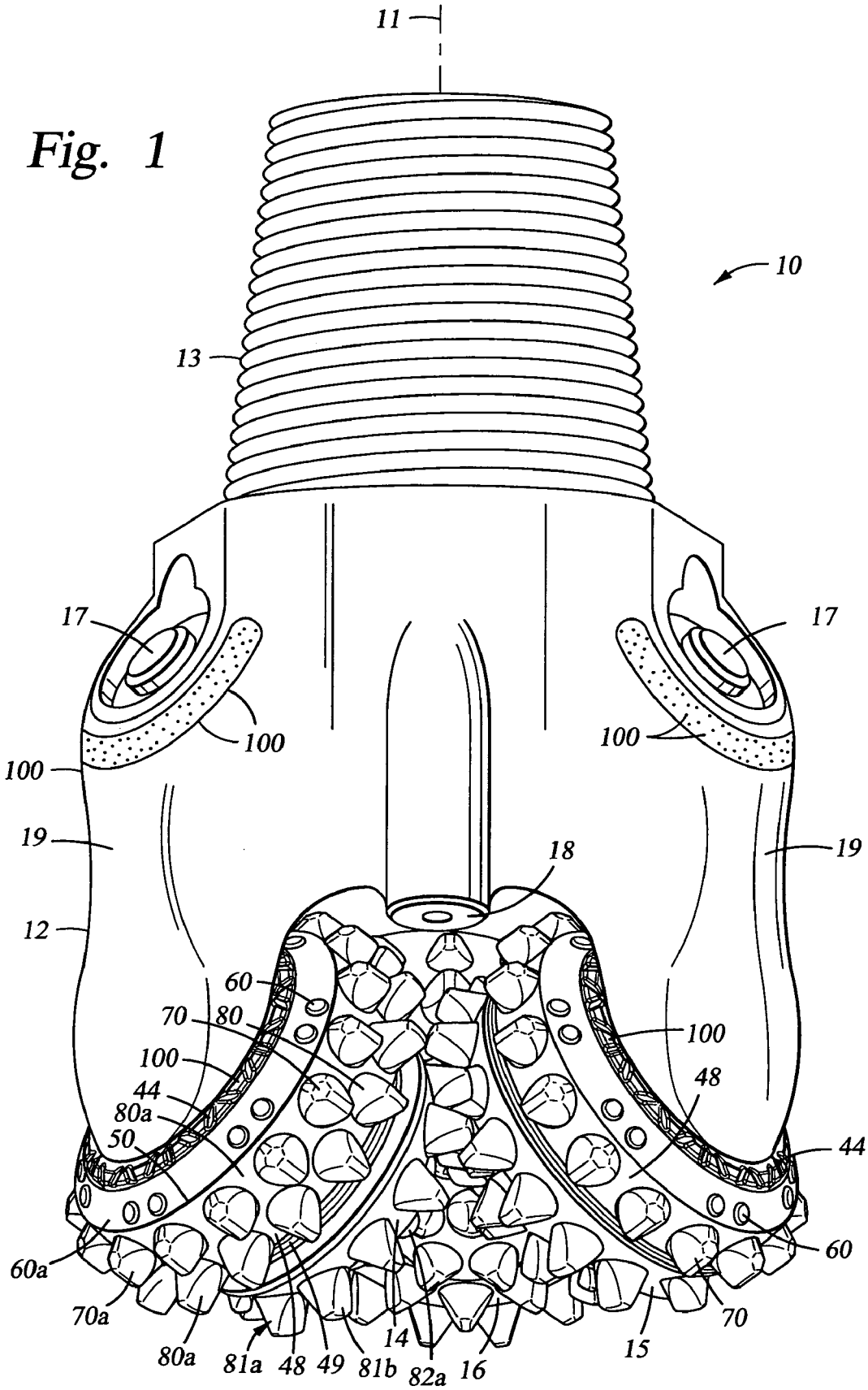
FIG. 1 is a perspective view of an earth-boring bit made in accordance with principles of the present invention.

Referring first to FIG. 1, an earth-boring bit 10 includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14-16. Bit 10 further includes lubricant reservoirs 17 that supply lubricant to the bearings of each of the cutters.

Figure 2:
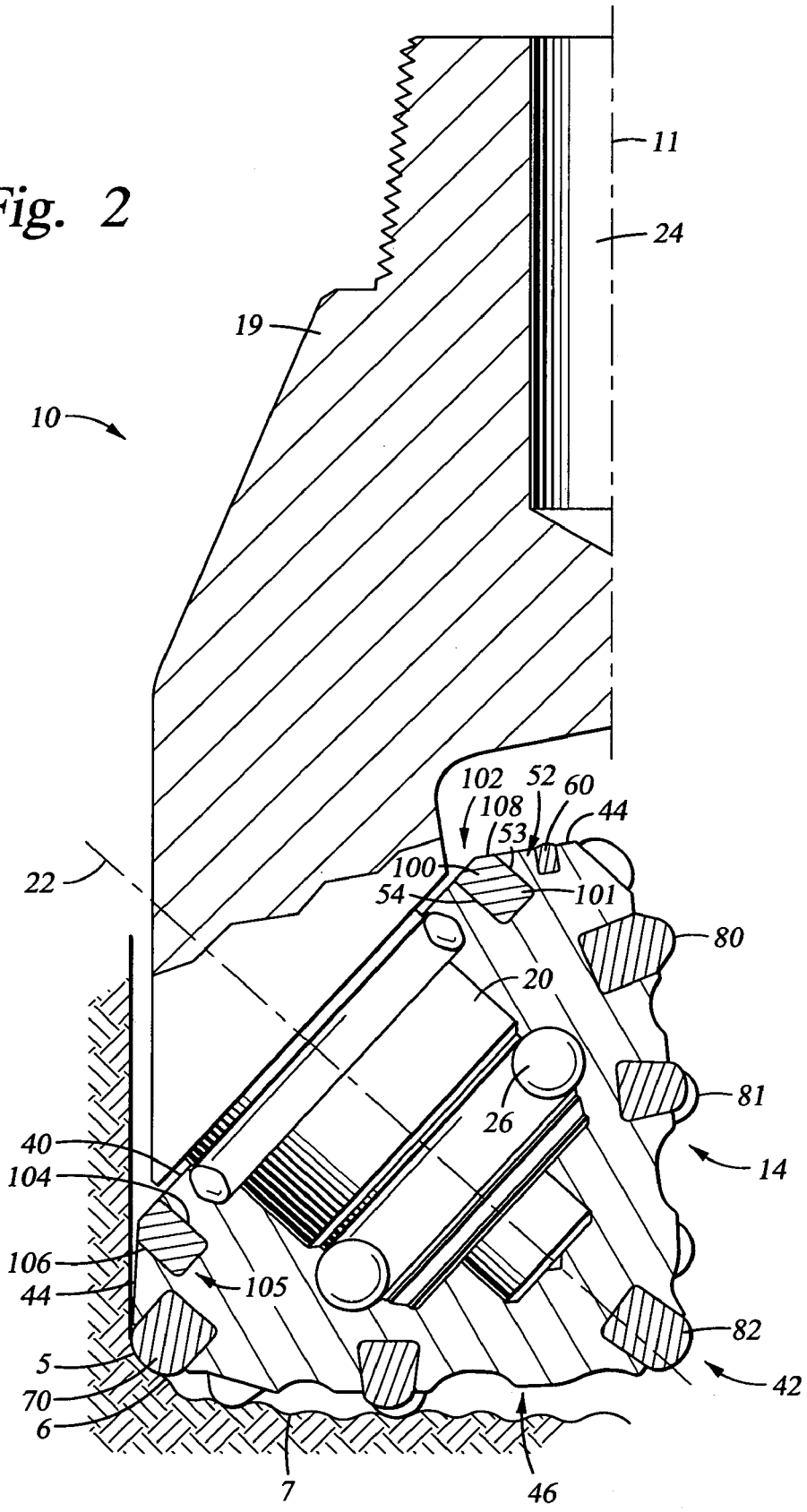
FIG. 2 is a partial section view taken through one leg and one rolling cone cutter of the bit shown in FIG. 1.

Referring now to FIG. 2 in conjunction with FIG. 1, each cutter 14-16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14-16 is typically secured on pin 20 by ball bearings 26. The borehole created by bit 10 includes sidewall 5, corner portion 6 and bottom 7, best shown in FIG. 2.

Referring still to FIGS. 1 and 2, each cutter 14-16 includes a backface 40 and nose portion 42 spaced apart from backface 40. Cutters 14-16 further include a frustoconical surface 44 that is adapted to retain cutter elements that scrape or ream the sidewalls of the borehole as cutters 14-16 rotate about the borehole bottom. Frustoconical surface 44 will be referred to herein as the "heel" surface of cutters 14-16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally frustoconical segments 48 generally referred to as "lands" which are employed to support and secure the cutter elements. Grooves 49 are formed in cone surface 46 between adjacent lands 48. Frustoconical heel surface 44 and conical surface 46 converge in a circumferential edge or shoulder 50.

In the embodiment of the invention shown in FIGS. 1 and 2, each cutter 14-16 includes a plurality of cylindrical-based, wear resistant inserts 60, 70, 80 that are secured by interference fit into mating sockets formed in the lands of the cone cutter, and cutting portions that are connected to the base portions and that extend beyond the surface of the cone cutter. The cutting portion includes a cutting surface that extends beyond cone surfaces 44, 46 for cutting formation material. The present invention will be understood with reference to one such cutter 14, cones 15, 16 being similarly, although not necessarily identically, configured.

Cone cutter 14 includes a plurality of heel row inserts 60 that are secured in a circumferential row 60*a* in the frustoconical heel surface 44. Cutter 14 further includes a circumferential row 70*a* of gage inserts 70 secured to cutter 14 in locations along or near the circumferential shoulder 50. Cutter 14 also includes a plurality of inner row inserts, such as inserts 80, 81, 82, secured to cone surface 46 and arranged in spaced-apart inner rows 80*a*, 81*a*, 82*a*, respectively. Heel inserts 60 generally function to scrape or ream the borehole sidewall 5 to maintain the borehole at full gage and prevent erosion and abrasion of heel surface 44. Cutter elements 80, 81, and 82 of inner rows 80*a*, 81*a*, 82*a*, are employed primarily to gouge and remove formation material from the borehole bottom 7. Inner rows 80*a*, 81*a*, 82*a*, are arranged and spaced on cutter 14 so as not to interfere with the inner rows on each of the other cone cutters 15, 16.

Figure 3:
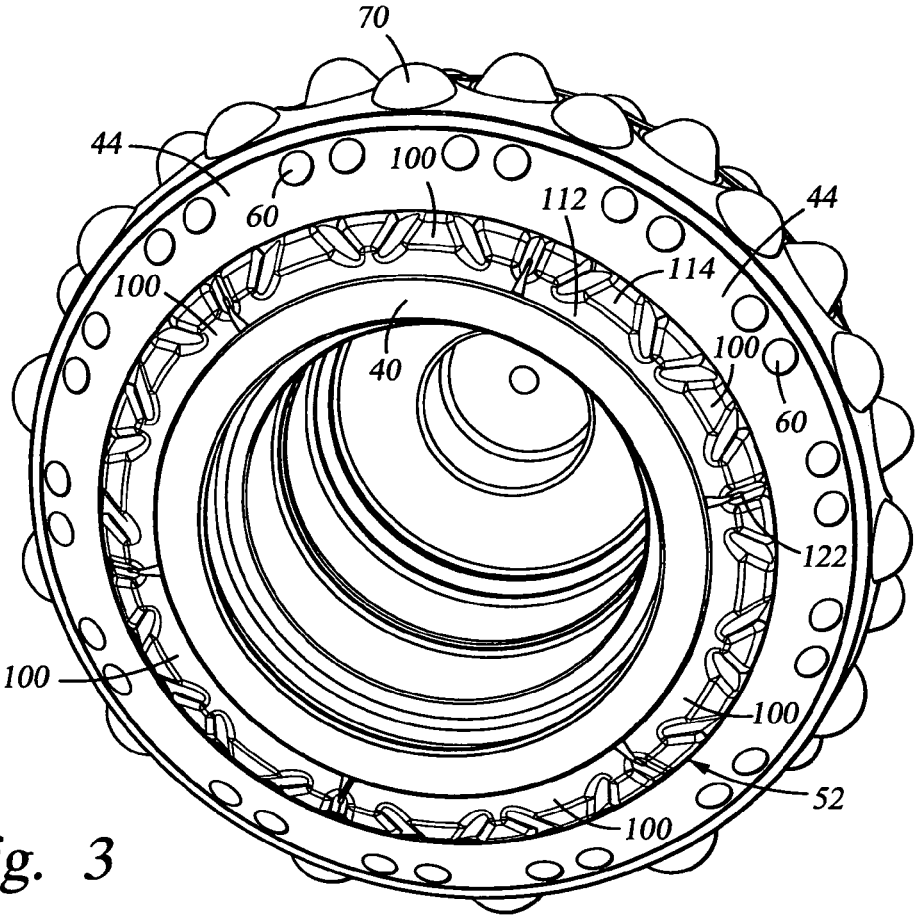
FIG. 3 is a perspective view of one cutter of the bit of FIG. 1.

Referring now to FIGS. 2 and 3, disposed radially inwardly from heel row inserts 60 are arcuate inserts 100. Arcuate inserts 100 include base portions 101 and cutting portions 102. Base portions 101 are press fit into a circumferential channel or groove 52 formed generally at the intersection of backface 40 and heel surface 44. Arcuate inserts 100, in this embodiment, include a bottom surface 105 that is substantially perpendicular to axis 22, and inner side surfaces 104 and outer side surfaces 106 that, in cross section, are substantially parallel to cone axis 22. Cutting portions 102 of arcuate inserts 100 include a cutting surface 108 that extends between side surfaces 104, 106 and above the surface of cone 14 and presents a cutting surface for engaging the formation material.

As best shown in FIG. 3, in this embodiment, cone 14 includes six arcuate inserts 100 in retaining groove 52, each insert 100 spanning the arc corresponding to an angle of substantially sixty degrees. For purposes of this application, each of these inserts 100 may be said to be a "sixty degree" arcuate insert. Depending on the size of the cone and other factors, a different number of arcuate inserts of different arcuate lengths and corresponding angles may be employed. For example, it may be desirable in certain applications to insert nine arcuate inserts that each span substantially 40 degrees. In other applications, a single ring-shaped insert having a 360° arcuate length may fill the retaining groove 52. Where a plurality of arcuate inserts 100 are employed in groove 52, it is preferred that the ends 110 of each insert 100 touch the ends 110 of the adjacent arcuate inserts. In this end-to-end arrangement, inserts 100 substantially fill retaining groove 52 such that there are no voids in groove 52, a "void" as used in this context meaning a groove segment that is not substantially filled by an insert 100.

Figure 4:
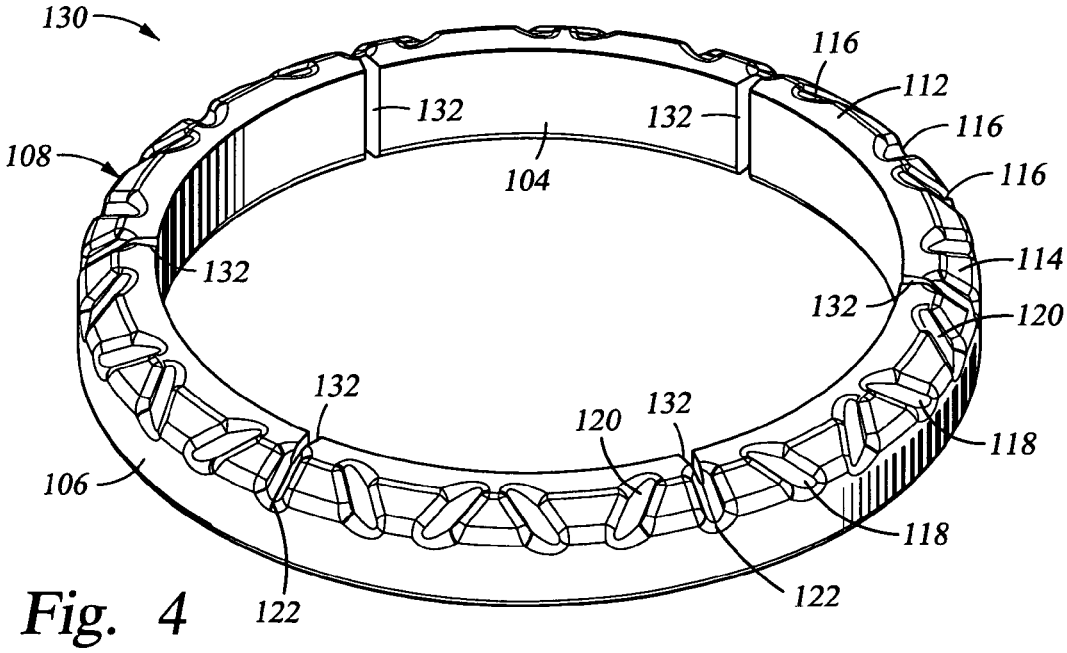
FIG. 4 is a perspective view of a ring shaped insert prior to assembly on to the cone cutter of FIG. 3.
Figure 5:
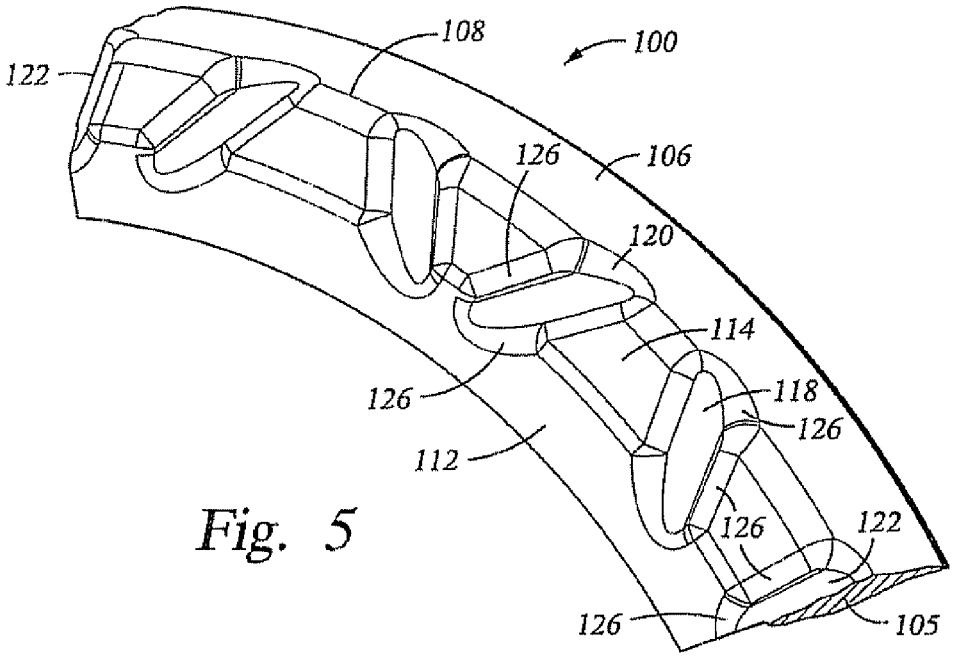
FIG. 5 is a perspective view of an arcuate insert formed from the ring shaped insert shown in FIG. 4.

Referring to FIGS. 4 and 5, cutting surface 108 is generally described as being formed by two regions, an inner annular surface 112 generally co-planar with back face 40, and an outer annular surface 114 that generally matches the contours of frustoconical heel surface 44. The cutting surface 108 of the arcuate inserts 100 further includes relatively short grooves 116 disposed along surface 114 and extending slightly into surface 112. The grooves 116 include grooves 118 that have a positive backrake angle relative to the formation material engaged as the cone cutter 14 rotates within the borehole, grooves 120 that have a negative backrake angle, as well as groove 122 that generally extend in a radial direction with respect to cone axis 22. Collectively, the edges 126 (FIG. 5) of grooves 118, 120, 122 provide an enhanced cutting surface for reaming and otherwise cutting the borehole sidewall.

To generate a tight fit between arcuate-shaped inserts 100 and sides 53, 54 of groove 52, the outer diameter of the groove 52 is formed so as to be smaller than the outer diameter of the arcuate inserts 100, and the inner diameter of the groove 52 being slightly larger than the inner diameter of the arcuate inserts 100, thus creating an "interference fit" between inserts 100 and groove 52.

Press fitting the arcuate-shaped inserts into the circumferential groove 52 is the preferred manner of attaching inserts 100 to the cone material. Although arcuate inserts 100 could be brazed or welded to the cone steel, those processes could detrimentally affect the bearing surface of the cone 14. More specifically, the heat required to weld or braze the arcuate inserts to the cone steel could damage the heat treatment provided to the steel of the cone bearing. Further, such processes impose thermal stresses on the inserts that can severely diminish the capacity of the arcuate insert to resist breakage or rotation within its groove. By contrast, press fitting the inserts 100 into groove 52 imparts no heating to the cone steel or to the inserts, and therefore is an efficient process having no detrimental consequences.

Preferably, arcuate inserts 100 ate formed in a single manufacturing process in which all six arcuate inserts 100 are initially formed as a ring-shaped insert 130 with all inserts 100 being interconnected. Such a ring-shaped insert 130 is best shown in FIG. 4. In this embodiment, ring-shaped 130 includes six notches 132 that are formed substantially sixty degrees apart and that extend along inner surface 104 in a direction parallel to cone axis 22. Notches 132 extend from bottom surface 105 to cutting surface 108 and extend radially into the ring 130 a distance that varies depending on the fracture toughness of ring material. Fracture toughness of a material is a commonly understood material property that refers to the capacity of a material to resist fracture, and is measured in units such as Kg per $mm^{3/2}$ The radial extent of notches 132 is selected to ensure formation of arcuate inserts 100 from the ring 130 through fracture of ring 130 while it is assembled on the cone. For example, for a tungsten carbide ring 130 such as shown in FIG. 4, having an inner diameter equal to approximately 2.95 inches, an outer diameter equal to approximately 3.63 inches and a height of approximately 0.5 inches measured from the bottom surface 105 to the uppermost portion of the cutting surface 108, notches 130 may extend approximately 63% of the thickness of the ring 130 as measured between side surfaces 104, 106. As shown in FIG. 4, a radially oriented groove 122 is formed in cutting surface 108 so as to guide the direction of the fracture along axial notch 132.

Ring 130 and inserts 100 of the embodiment of FIGS. 3 and 4 are preferably made of materials having a hardness preferably greater than 500 Knoop, and even more preferably greater than 750 Knoop. Such materials include, but are not limited to, tungsten carbide, boron nitride, and polycrystalline diamond. Ring-shaped insert 130 is preferably formed by hot isostatic pressing (HIP). HIP techniques are well known manufacturing methods that employ high pressure and high temperature to consolidate metal, ceramic, or composite powder to fabricate components in desired shapes. Information regarding HIP techniques useful in forming ring-shaped insert 130 and the other arcuate and ring-shaped inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, ring insert 130 and the other arcuate inserts described herein can be made using other conventional manufacturing processes, such as hot pressing, rapid omnidirectional compaction, vacuum sintering, or sinter-HIP.

After the manufacture of ring-shaped insert 130 of FIG. 4 is completed, it is press fit into circumferential groove 52 in cone 14 using conventional techniques. Groove 52 has an inner radius that is larger than the inner radius of insert ring 130, and an outer radius that is smaller than the outer radius of ring 130. The press fitting of ring-shaped insert 130 into groove 52 produces a tensile stress field along the circumference of a ring-shaped insert 130. The hard materials from which ring-shaped insert 130 is preferably made have a very low capacity for tensile deformation. The assembly process of press fitting ring insert 130 on cone cutter 14 leads to storage of substantial tensile stress in the ring such that, but for features designed into ring 130, could result in unpredicted fracture of the ring.

However, the introduction of notches 132 in ring-shaped insert 130 of FIG. 4 relieves the tensile stress imposed when press fitting ring 130 into cone 14, notches 132 therefore may appropriately be characterized and referred to as "stress relief discontinuities." Specifically, during the assembly of ring-shaped insert 130 into groove 52, when the tensile stress at the notches 132 exceeds a predetermined magnitude, a crack in ring 130 will form at notches 132 and will propagate entirely through the ring along a pre-designed fracture path formed by groove 122 along cutting surface 108. In other words, the crack develops at notches 132 and the direction of the crack is directed generally radially outwardly by means of groove 122. With this controlled fracturing occurring at each notch 132, ring-shaped insert 130 of the embodiment shown in FIG. 4 fractures into the six arcuate-shaped inserts 100, shown in FIG. 3. Arcuate-shaped inserts 100, smaller as compared to ring insert 130, are stronger in their ability to withstand bending loads. Further, the likelihood of inserts 100 rotating within groove 52 is lessened as compared to a complete ring insert 130. Finally, little detrimental tensile energy is stored in insert 100, as compared to ring insert 130, and thus it is less likely to fracture when drilling begins.

In some instances, depending upon factors including the materials employed in manufacturing ring-shaped insert 130, the number and spacing of notches 132, the size of cone 14 and other factors, ring insert 130 will not fracture at every notch 132 upon assembly. Where the ring fractures at only some of notches 132 upon assembly, groove 52 will thus be filled with a plurality of arcuate inserts of different arcuate lengths For example, and referring to FIG. 4, upon assembly of ring-shaped insert 130 into groove 52 of cone 14, it is possible that the ring 130 fractures such that the groove is filled with two arcuate inserts of a length corresponding to a sixty degree angle (sixty degree arcuate inserts), and two corresponding to a 120 degree angle (120 degree arcuate inserts), the two 120 degree arcuate inserts including a notch 132 substantially at the midpoint. However, after the cone cutter 14 is assembled on bit 10 and weight is applied to the bit while drilling, additional tensile stress is generated due to contact between the arcuate insert and the formation material. When this occurs, the two 120 degree arcuate segments may fracture at the remaining notches 132.

Manufacturing ring insert 130 to fracture into arcuate shaped inserts 100 (either when press fit into groove 52 or upon commencement of drilling activity) provides advantages in certain applications over a ring shaped insert that is not configured to fracture in a controlled, predicted manner. First, what would otherwise be detrimental tensile stresses in a ring shaped insert can be eliminated by allowing crack propagation along predesigned surface grooves. Second, the 360° span of a ring insert has a low capacity for withstanding bending loads that are present when cutting rock formation, while shorter arcuate lengths are better able to withstand such bending loads. Further, separate arcuate inserts that are press fit into a 360° groove are less likely to rotate in the groove than a 360° insert. It should be understood, however, that ring-shaped inserts having a 360° arcuate length and that do not include pre-formed stress relief discontinuities designed to provide fracture at predetermined locations may also be employed, such embodiments being described in more detail below.

Referring again to FIGS. 2 and 3, arcuate inserts 100 filling circumferential groove 52 present to the formation material a continuous cutting surface 108 that is made from material having the desired characteristics of cutting ability, toughness and hardness. So positioned, arcuate inserts 100 provide maximum protection for the back face and heel surfaces of cone cutter 14. The continuous surface formed by inserts 100 afford superior wear resistance for cone cutter 14 due to the arcuate inserts' larger contact surface as compared to a design where individual, spaced apart cylindrical inserts are embedded in the cone surface. Employing arcuate inserts 100 as shown in FIGS. 2 and 3 avoids having areas between the hardened inserts that are susceptible to erosion and other wear, phenomena that, with conventional bits and cone cutters, can lead to loss of inserts and further reduction in ROP and loss of ability to maintain full gage diameter.

Figure 6:
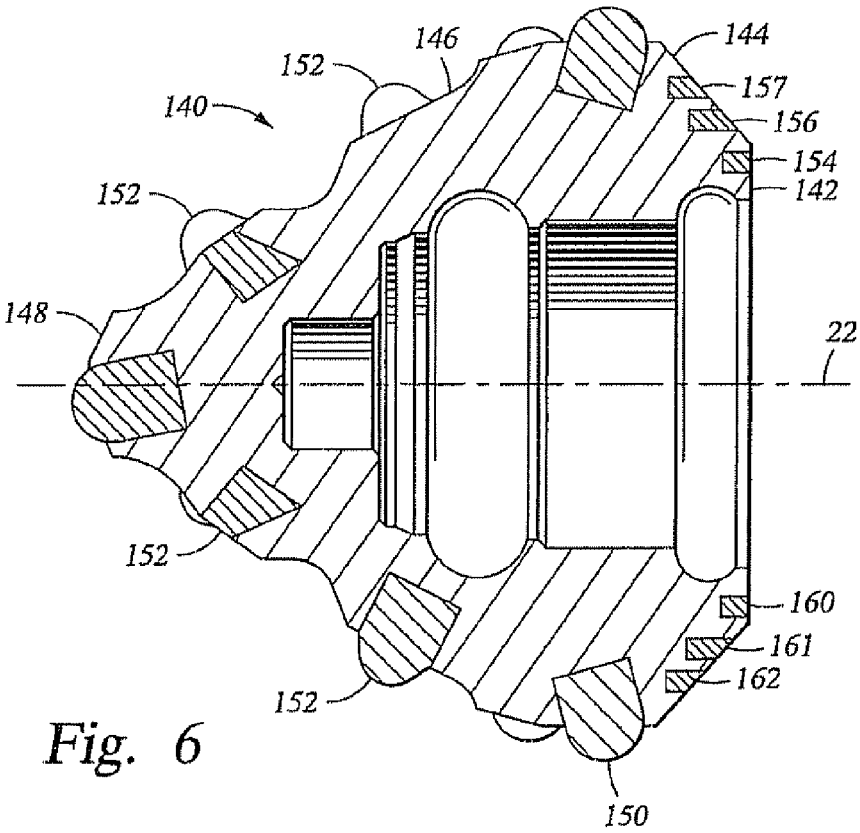
FIG. 6 is a partial section view of a cone cutter made in accordance with an alternative embodiment of the present invention.

Referring now to FIG. 6, another preferred embodiment of this invention is shown and includes rolling cone cutter 140 substantially similar to cone cutter 14 previously described. Rolling cone cutter 140 includes back face 142 adjacent to heel surface 144, cone nose 148 and a conical surface 146 extending between heel surface 144 and nose 148. Conventional, cylindrical-based, gage inserts 150 are disposed in cone 140 generally at the shoulder between heel surface 144 and conical surface 146, and a plurality of conventional, cylindrical-based inner row inserts 152 are disposed in rows in conical surface 146. Referring particularly to back face 142 and heel surface 144, cone 140 is shown to include groove 154 formed in back face 142, and a pair of grooves 156, 157 formed in heel surface 144. A ring shaped insert 160 substantially the same as insert 130 previously described is press fit into groove 154, ring insert 160 fracturing into a plurality of arcuate-shaped inserts that substantially fill groove 154 in an end-to-end configuration. Likewise, ring shaped inserts 161, 162 are press fit into grooves 156, 157, respectively, in heel surface 144 and, upon assembly, fracture into arcuate-shaped inserts substantially filling those grooves. Ring-shaped inserts 161, 162 may have identical cutting surfaces as employed in insert 160, or a different cutting surface. As previously described with respect to cone 14, the arrangement of arcuate inserts in cone 140 eliminates exposing the more vulnerable cone steel to the formation material, and instead presents a continuous cutting surface of hard, erosion-resistant material. As compared to the embodiment shown in FIGS. 2-3, cone 140, which includes arcuate inserts formed from three ring-shaped inserts 160-162, may be particularly desirable in cone cutters having relatively large heel surfaces 144.

The advantages presented by providing arcuate-shaped inserts in a cone cutter are not limited to only the backface and heel surfaces of rolling cone cutters. Specifically, and referring to FIG. 7, rolling cone cutter 170 is shown including arcuate-shaped inserts 100 which, as previously described, are press fit in groove 52 located in the region where back face 40 joins heel surface 44. Rolling cone cutter 170 differs from cone cutter 14 previously described in that an inner row of cylindrical-based inserts has been replaced by a plurality of arcuate-shaped inserts 172 that are press fit and substantially fill groove 174. As with arcuate inserts 100 and 160-162 previously described, arcuate inserts 172 are initially formed of hard material as a single, ring shaped insert, with notches disposed about the inner diameter of the ring so as to provide stress relief discontinuities allowing the ring to fragment into discrete arcuate segments of predetermined length.

Figure 7:
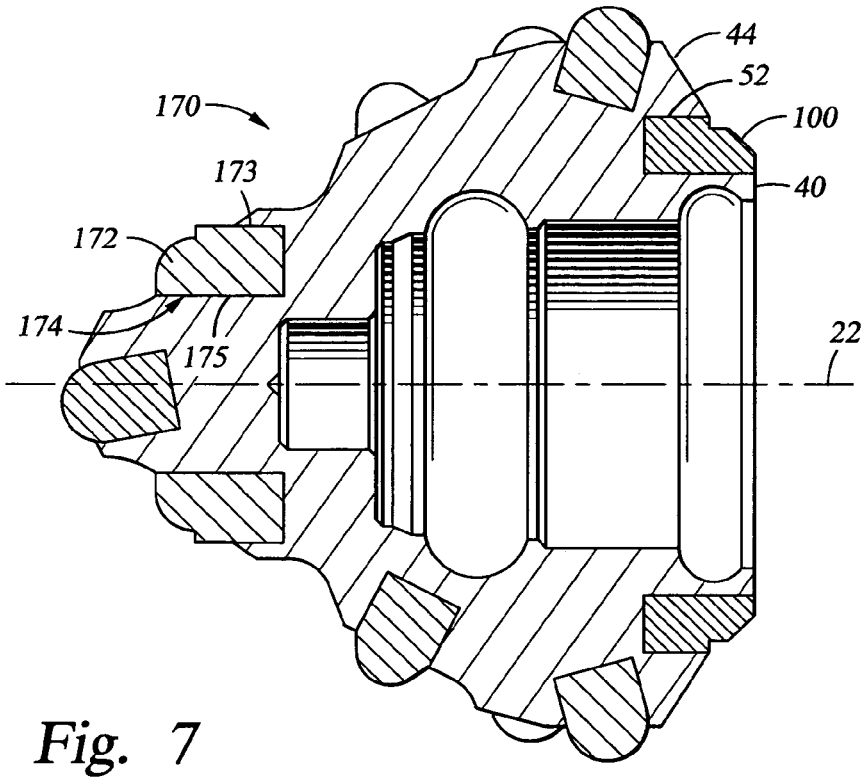
FIG. 7 is a partial section view of a cone cutter made in accordance with another alternative embodiment of the present invention.

Referring still to FIG. 7, being positioned in an inner row of cutting elements, arcuate inserts 172 are exposed to differing cutting duties as compared to arcuate inserts 100, for example, of the embodiment of FIGS. 2-3. More specifically, arcuate inserts 172 will be exposed to crushing and gouging of the borehole bottom as compared to the general reaming function of inserts 100 in the cone cutter 14 of FIGS. 2-3. Accordingly, because of the different duty, the cutting surface of arcuate inserts 172 in FIG. 7 may have a different configuration as compared to the cutting surface 108 previously described for arcuate inserts 100.

Figure 8A:
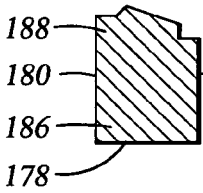
FIGS. 8A-8H are cross-sectional views of various alternative embodiments of the arcuate and ring shaped insert of the present invention.
Figure 8B:
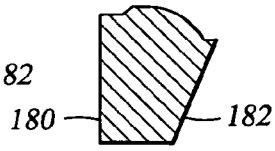
Figure 8C:
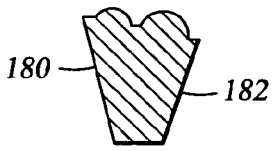
Figure 8D:
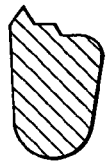
Figure 8E:
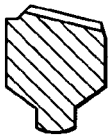
Figure 8F:
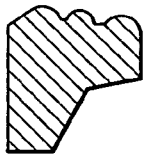
Figure 8G:
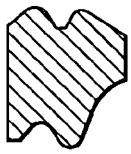
Figure 8H:
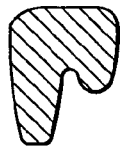

FIGS. 8A-8H show, in cross section, various preferred cross-sectional shapes of arcuate inserts contemplated for use in rolling cone cutters. It is preferred that each of these inserts be manufactured as a complete ring. Depending upon the application, the ring-shaped inserts may be manufactured with or without stress relief discontinuities spaced apart along the ring. As viewed in FIGS. 8A-8H, each arcuate insert includes a bottom surface 178, and an inner and outer surface 180, 182 respectively. Each also includes a base portion 186 for extending into and being retained by the cone material, and a cutting portion 188 extending beyond the cone material. The inner and outer surfaces 180, 182 may, in cross section, be parallel to one another and parallel to the cone axis, such as shown in FIG. 8A. However, in other embodiments, one or both of these surfaces may be nonparallel with respect to the cone axis 22, such as outer surface 182 of FIG. 8B, and inner and outer surfaces 180, 182 of FIG. 8C. As will be understood, the base portion 186 of the arcuate inserts may be narrower in cross-section than the cutting portion 188 as may be desirable or necessary to minimize loss of cone steel, or to avoid interference with other cutter elements, or to provide an enhanced gripping force to be applied to the arcuate insert. Similarly, the cutting portions 188 of the elements may be wider than the base portion so as to present to the formation material a layer cutting surface and to thereby provide greater protection to the underlying cone steel.

Where employed, the stress relief discontinuities may take various forms. Notches 132 previously described with respect to the embodiments of FIGS. 2-3 generally extend in a single direction parallel to cone axis 22 along the inner surface of the ring shaped insert 130. Such "unidirectional" stress relief discontinuities may have various shaped cross-sections. For example, notches 132 previously described may have a square shaped configuration or, more preferably, be U-shaped or V-shaped so as to better focus the tensile stress and better control the point of fracture of ring-shaped insert 130.

Figure 9:
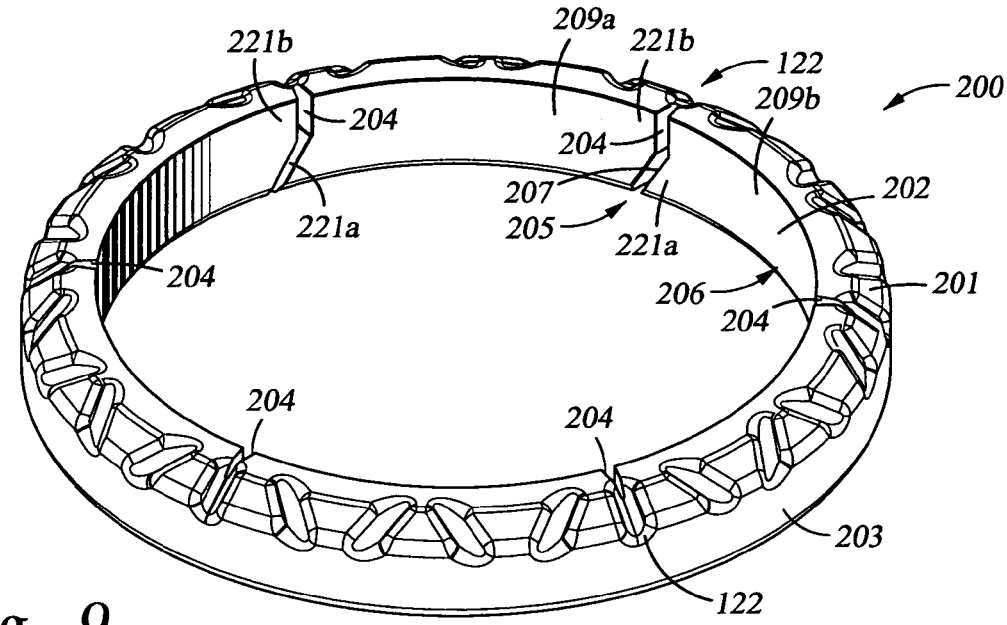
FIG. 9 is a perspective view, similar to FIG. 4, of another alternative embodiment of the present invention having non-linear, or three dimensional stress relief discontinuities.

Alternatively, and referring to FIG. 9, the stress relief discontinuities may include notches extending in multiple planes or directions, hereinafter referred to as 3D or 3-dimensional notches or stress relief discontinuities. As shown in FIG. 9, a ring-shaped insert 200 is shown having a cutting surface 201 that is substantially the same as cutting surface 108 previously described with respect to ring-shaped insert 130. Disposed about sixty degrees apart along inner surface 202 of ring-shaped insert 200 are a plurality of 3D stress relief discontinuities 204. 3D notches 204 extend from bottom surface 206 of ring-shaped insert 200 in a first direction until it reaches a point substantially halfway between cutting surface 201 and bottom surface 206, at which point the notch changes directions and extends in a direction generally parallel to cone axis 22 and into cutting surface 201. A radially aligned groove 122 in cutter surface 201 intersects each 3D notch 204 so as to direct the fracture in a pre-determined direction. The extent that the 3D notches 204 extend into the ring as measured from inner surface 202 will again be dependent upon the fracture toughness of the material. As an example, for a ring insert 200 having dimensions similar to those previously described with respect to FIG. 4 and made of tungsten carbide, the notch depth may extend approximately 63% of the thickness of ring-shaped insert 200 as measured between inner and outer surfaces of 202, 203.

Figure 10:
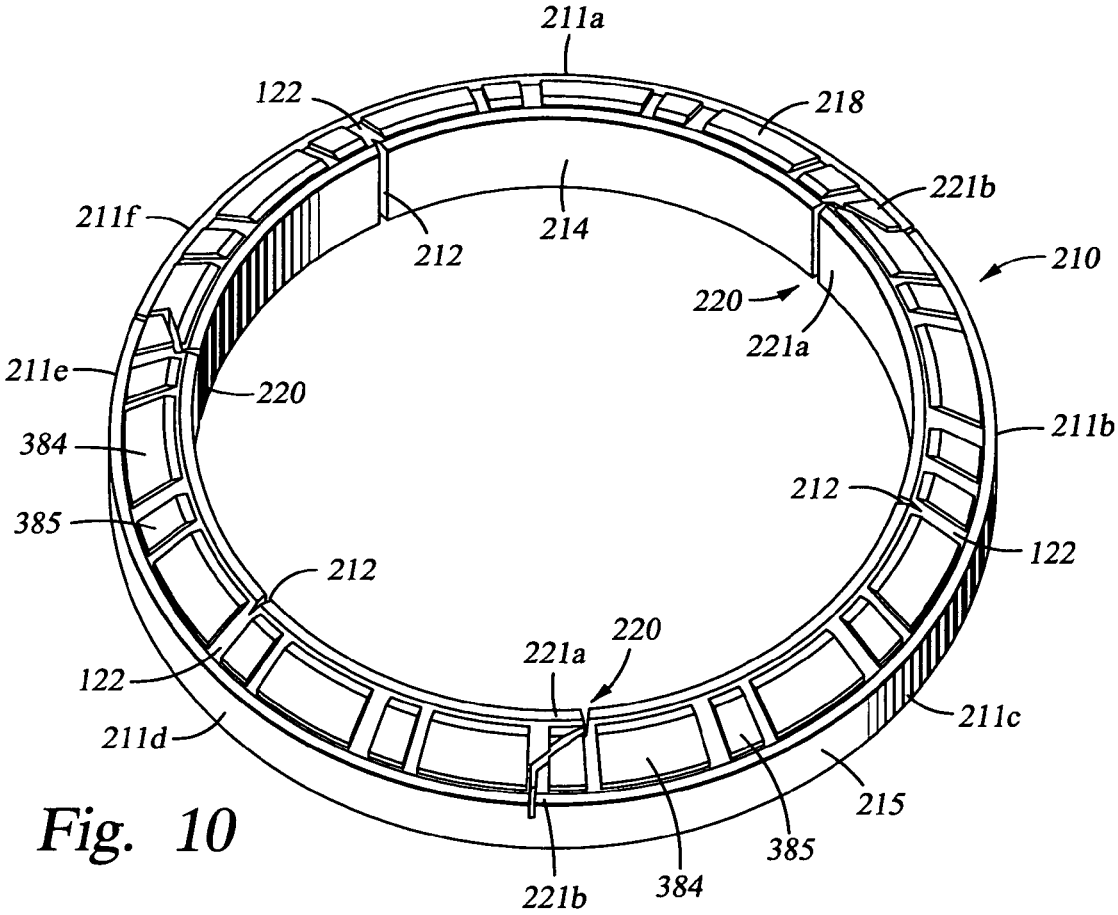
FIG. 10 is a perspective view, similar to FIG. 9, of another alternative embodiment of the present invention.

Referring to FIG. 10, alternative 3D stress relief discontinuities are shown. Here, a ring-shaped insert 210 is shown to include three notches 212 that have a generally V-shaped cross-section and are disposed approximately 120 degrees apart along inner surface 214. Each notch 212 generally intersects a radially aligned groove 122 formed in cutting surface 218 so as to direct a fracture at notch 212 radially outward. In addition, ring-shaped insert 210 further includes three 3D stress relief discontinuities 220 which are likewise spaced approximately 120 degrees apart. Each 3D discontinuity 220 generally extends the entire height of ring 210 along inner surface 214, and then extends across cutting surface 218 at an angle relative to the radius of ring 210, and then turns and extends to the outer surface 215 in a generally radial direction. As described, each 3D stress relief discontinuity 220 extends in generally three segments, and extends along both the inner surface 214 and the cutting surface 218 of ring insert 210.

Once installed in a cone cutter, the ring-shaped inserts 200 and 210 of FIGS. 9 and 10, fragment to form arcuate-shaped inserts having non-planer ends 221*a,b* that generally meet and engage non-planer and correspondingly shaped ends of the adjacent arcuate inserts. This non-planer contact between the ends 221*a,b* of adjacent inserts provides additional resistance to rotation within the groove by redirecting tangential forces, that tend to induce rotation, into other directions, including radially, which tend to resist rotation.

For example, referring to FIG. 9, when placed in a retaining groove, ring insert 200 preferably will fragment into a plurality of arcuate shaped inserts including inserts 209*a*, 209*b*. An interface 205 between inserts 209*a*, 209*b* will exist at stress discontinuity 204. The interface 205 includes an angled surface 207 on insert 209*b* due to the predetermined shape or orientation of discontinuity 204. As such, some of the tangential force applied to insert 209*a* by the formation during drilling will be applied to insert 209*b* normal to angled surface 207 at interface 205. When placed in a groove such as groove 52 shown in the bit of FIG. 2, a component of that force on surface 207 is applied axially (relative to cone axis 22 shown in FIG. 2) which would tend to press arcuate insert 209*b* more firmly against the bottom of the groove 52 allowing the insert to better resist rotation. Similarly, the orientation of the 3D stress relief discontinuities 220 shown in ring insert 210 of FIG. 10 will cause forces imparted on the arcuate inserts identified as 211*a-f* (as formed when ring insert 210 fractures as designed) to be redirected, a portion of such forces being radially directed so as to better secure the arcuate inserts 211 to resist rotation.

Figure 11:
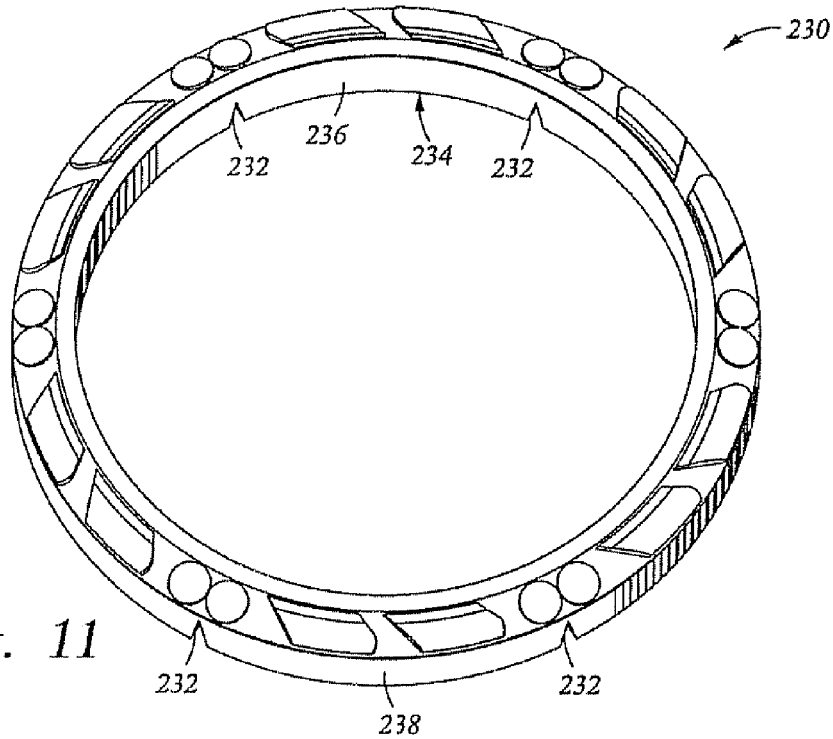
FIG. 11 is a perspective view, similar to FIGS. 9 and 10, showing still further alternative embodiments of the present invention.

Stress relief discontinuities of another type are shown in FIG. 11 wherein V-shaped notches 232 are formed across the bottom surface 234 of ring-shaped insert 230. As shown, the V-shaped notch 232 extends between inner surface 236 and outer surface 238 of ring-shaped insert 230. As an example, these notches 232 may extend approximately 60% of the height of ring insert 230, or more. Stress relief discontinuity 232 shown in FIG. 11 provides certain manufacturing advantages and provides the desired direction for fracture propagation without the need of forming a directing groove in the cutting surface, such as the grooves 122 previously described with respect to FIGS. 3-4.

In the context of the present invention, a single arcuate or ring shaped insert can be made of multiple materials in a single HIP manufacturing step. For example, referring to FIG. 12, a ring shaped insert 250 made of multiple materials is shown to include a base portion 252 and cutting portion 254. Cutting portion 254 includes a cutting surface 256 which, in this embodiment, includes a pattern of alternating large and small protrusions 258, 260. Protrusions 258, 260 are best described as hemispherical or done shaped protrusions having truncated tops, resulting in flat tops 268, 270. Ring 250 is formed using three different materials that are loaded sequentially in the mold such that ring 250 includes axially-stacked layers: lower layer 262, intermediate layer 264 and upper layer 266. In this embodiment, lower layer 262 is held firmly within a circumferential groove in a cone cutter, while outer layer 266 provides the cutting action and engages the formation material. Intermediate layer 264 is a transition layer between layers 262 and 266 and provides a bridging layer between the materials 262, 266 which, because they are intended to serve different functions, have different material characteristics. In this manner, the materials in different layers of ring-shaped insert 250 may be optimized to better withstand a particular duty.

Figure 12:
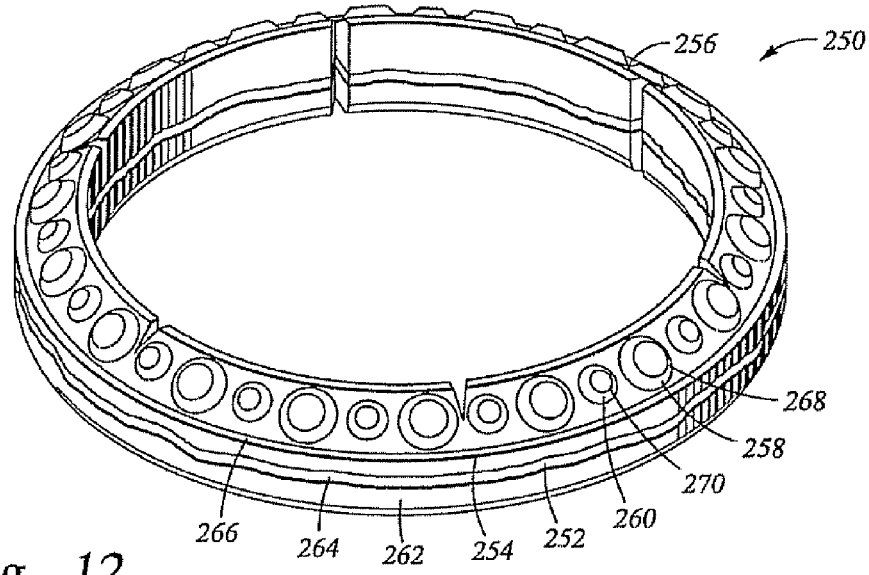
FIG. 12 is a perspective view of another alternative embodiment of the present invention wherein the ring shaped insert is made of layers of different materials.
Figure 13A:
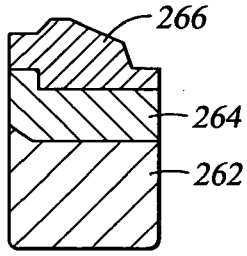
FIGS. 13A-13H are cross-sectional views of various alternative embodiments of the arcuate and ring shaped inserts of the present invention where the inserts are made of multiple materials.

FIGS. 13A-13H illustrate, in cross-section, various preferred embodiments of the ring and arcuate-shaped inserts that incorporate multiple materials in a given insert. FIG. 13A is a cross-sectional view of the ring shaped insert 250 of FIG. 12 having axially stacked layers 262, 264 and 266. Preferably, material 266 is the hardest of the three layers for resisting wear and for cutting formation, while layer 262 is tougher (generally meaning having greater ability to withstand impact loading without breakage), but is less hard. Layer 264 is tougher than layer 266 and harder than layer 262, and is provided between 262 and 266 to transition between the thermal and mechanical differences of layer 262 and 266.

Figure 13B:
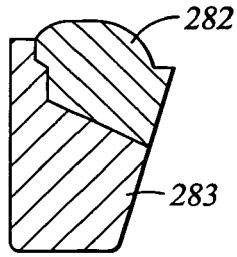
Figure 13C:
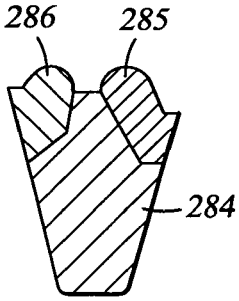

In the embodiment shown in FIG. 13B, material layer 282 is the harder of the two materials and is disposed generally on the radially outermost portion of the ring to enhance wear resistance at that location. Material segments 283 is less hard, but tougher. In the embodiment shown in FIG. 13C, material 284 is the toughest, but least hard of the three materials. Material segments 285 and 286 may have the same hardness or, alternatively, may have different hardnesses, the materials being optimized for the particular duty experienced by that portion of the ring shaped insert. Generally, in this configuration, it is preferred that material 285 be more wear resistant than material 286.

Figure 13D:
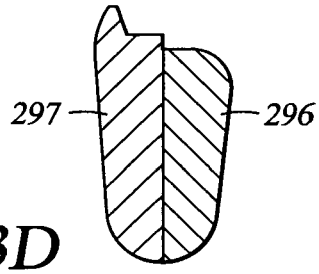

Referring to FIG. 13D, the insert is generally formed by two materials such that the inner portion of the insert is formed by material 297 and the outer portion by material 296. Generally, material 296 would be harder and more wear resistant than material 297.

Figure 13E:
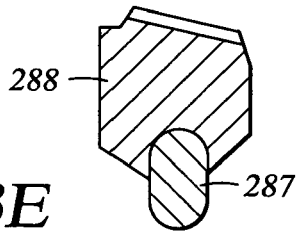
Figure 13F:
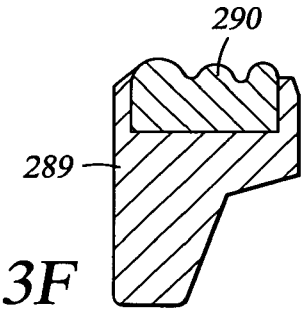

In the embodiment shown in FIG. 13E, material 288 would generally be made of a harder material than portion 287, the material of portion 287 having a greater toughness. In the embodiment shown in FIG. 13F, material 290 is the harder of the two and better able to resist wear, while material 289 is tougher and better able to resist breakage.

Figure 13G:
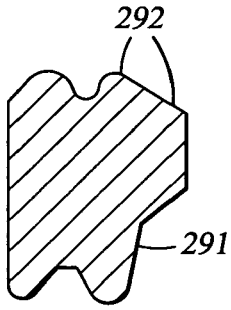

FIG. 13G depicts, in cross-section, an arcuate insert made of composite materials including material 291 (shown with cross-hatching) and 292 (represented by dark particles). The resulting material made from a composite of materials 291, 292 will differ in characteristics from that of either 291 or 292, the materials 291 and 292 being mixed in various proportions so as to optimize the properties of the entire insert.

Figure 13H:
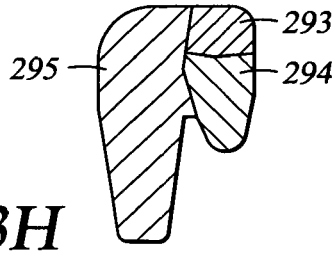

Referring to FIG. 13H, the insert is formed of materials 293, 294, and 295. Generally, materials 293 and 294 will be harder and will better resist wear than material 295. Material 295 is retained within the groove of the cone cutter and is tougher and less likely to break than if it were made of a harder material like materials 293, 294.

Figure 14:
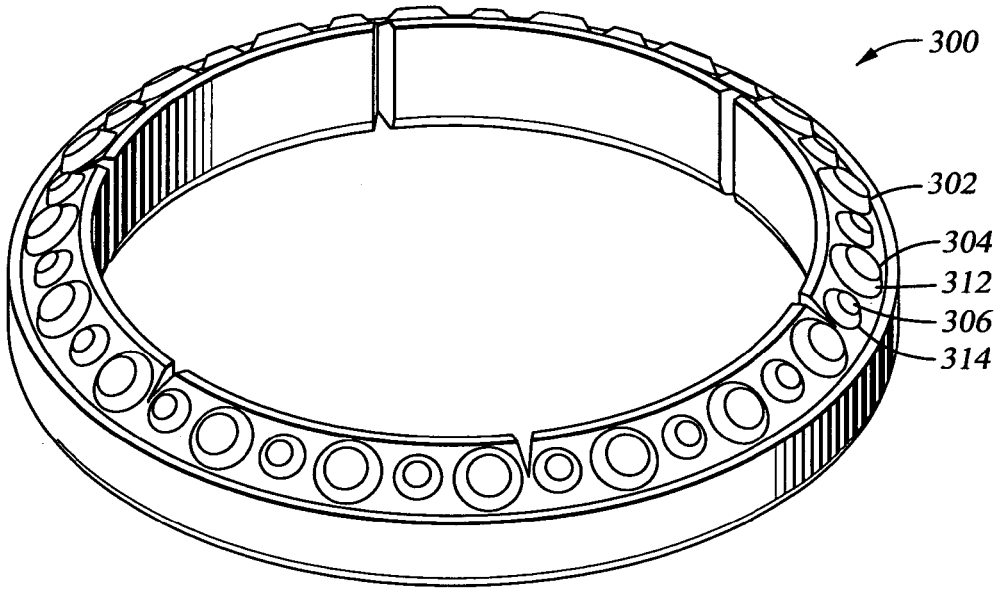
FIG. 14 is a perspective view of another alternative embodiment of the present invention.

In addition to using multiple materials as previously described with reference FIGS. 12 and 13, the materials can be varied within a single arcuate segment of a ring shaped insert. For example, referring to FIG. 14, ring shaped insert 300 is shown to include a cutting surface 302 that includes alternating large and small protrusions 304, 306. In this embodiment, large protrusions 304 are made of a first material 312 while small protrusions 306 are made with a second material 314. These materials may be varied depending on the particular cutting duty required of cutting surface 302. In one preferred embodiment, the materials used in large protrusion 304 will be tougher than the materials used in the smaller protrusions 306 which are formed of a harder, more wear resistant material.

Figure 15:
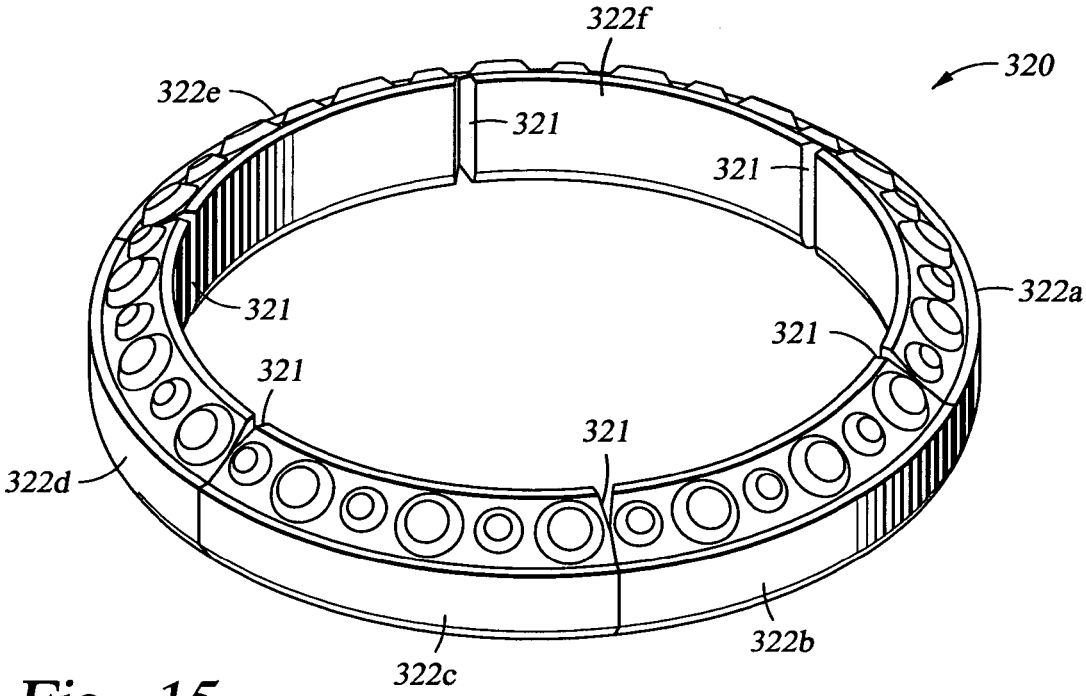
FIG. 15 is a perspective view of another alternative embodiment of the present invention.

In a similar manner, materials may be varied so as to produce a ring shaped insert where the material forming the various arcuate segments differs from segment to segment. More specifically, referring to FIG. 15, ring shaped insert 320 is formed via a conventional process and includes stress relief discontinuities or notches 321 disposed approximately 60 degrees apart. Upon press fitting of ring shaped insert 320 into a groove in a rolling cone cutter, ring 320 will fracture along notches 321 to form six arcuate-shaped inserts 322*a*-322*f*. While each such insert could be made of the same material, it may be desirable in certain instances, such as where a wide variety of formations will be drilled, to vary the materials used to form arcuate segments. Accordingly, in the embodiment shown in FIG. 15, arcuate insert segments 322*a* and 322*d* are made of first material, arcuate inserts 322*b*, 322*e* made of a second material and arcuate inserts 322*c*, 322*f* made of a third material, where the three materials have differing characteristics, particularly with respect to hardness, wear resistance and toughness. As an alternative to press fitting ring 320 into a groove, separately formed arcuate inserts (for example, six inserts having 60 degree arcuate lengths) could be manufactured and separately press fit into the cone groove.

Figure 16A:
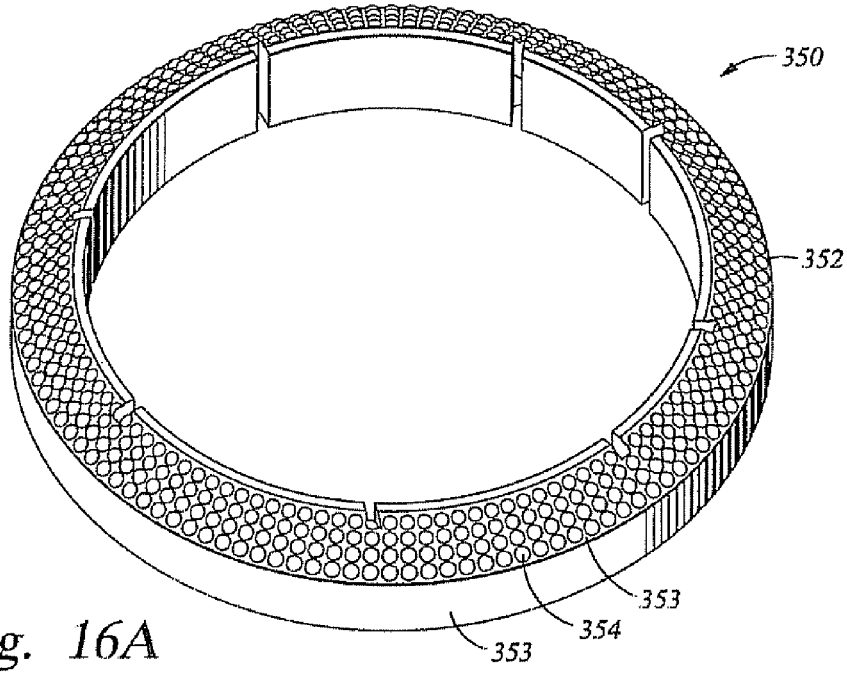
FIGS. 16A-16F are perspective views of various alternative embodiments of the present invention having alternative cutting surfaces.
Figure 16B:
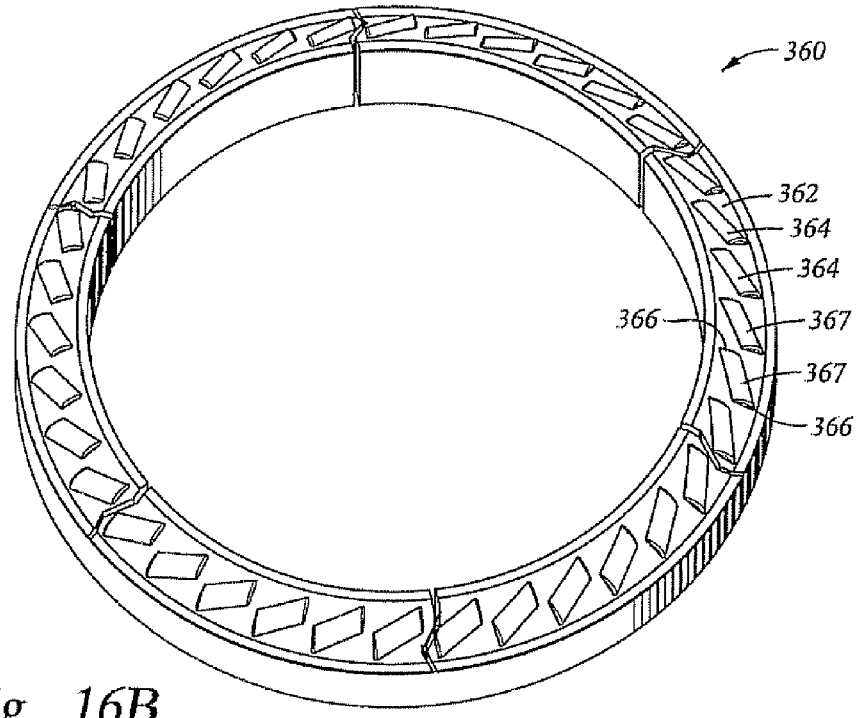

The preferred embodiments of the invention may be made such that the arcuate inserts include a variety of different cutting surfaces, the choice of which will be determined, in part, based on the characteristics of the formation expected to be encountered. One preferred cutting surface 108 has previously been described with reference to arcuate insert 100 as shown in FIGS. 3-5. FIGS. 16A-F depict additional cutting surfaces applicable to the present invention, the cutting surfaces being shown applied to ring-shaped or 360° arcuate inserts. Referring first to FIG. 16A, 180 degree arcuate insert 350 includes cutting surface 352 comprised of radially extending rows 353 of dome shaped protrusions 354. Arcuate insert 360 as shown in FIG. 16B includes a cutting surface 362 that includes generally rod-shaped protrusions 364. The ends 366 as well as the crest 367 of protrusions 364 present cutting surfaces with varying degrees of negative and positive back rake.

Figure 16C:
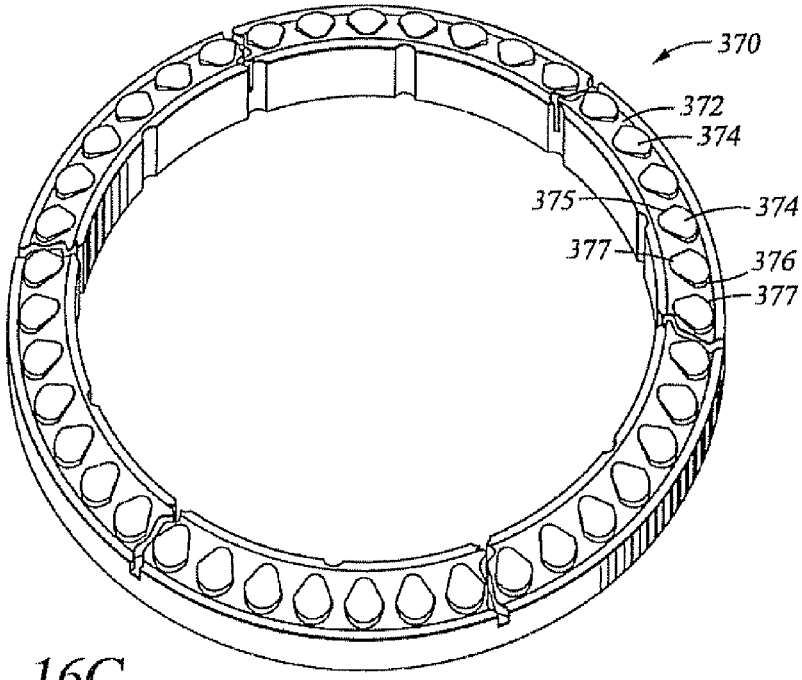
Figure 16D:
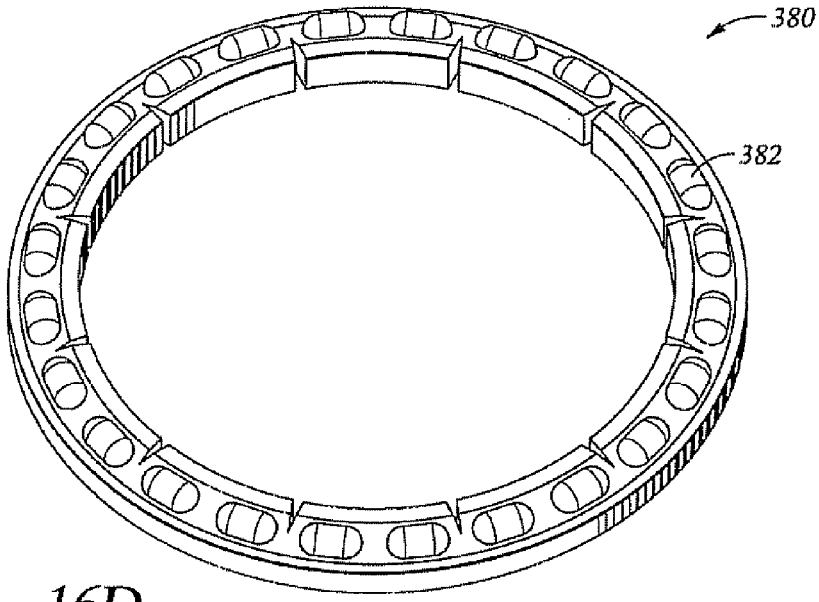

Arcuate insert 370 shown in FIG. 16C includes a cutting surface 372 having a plurality of wedge shaped protrusions 374. Protrusions 374 are oriented such that their narrowest ends 375 extend radially inward, towards cone axis 22.

Protrusions 374 are the highest at their radially outermost or widest end 376. The edges 377 around protrusions 374 provide cutting surfaces that are particularly useful in reaming duty. Similarly, protrusions on the cutting surface of the arcuate-shaped inserts may be oblong, such as protrusions 382 shown in the arcuate insert 380 of FIG. 16D, or the generally rectangular protrusions 384, 385 shown in FIG. 10.

Figure 16E:
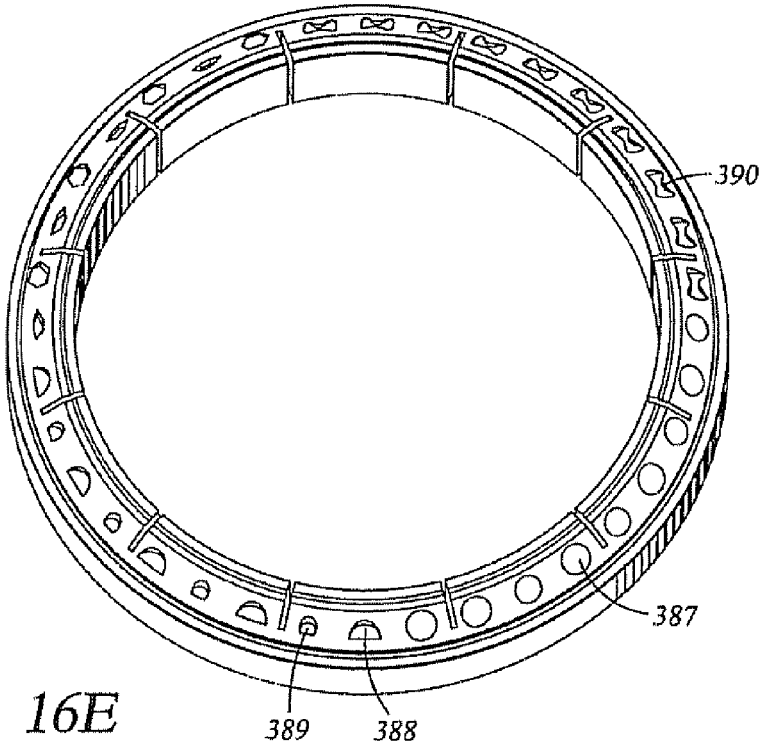
Figure 16F:
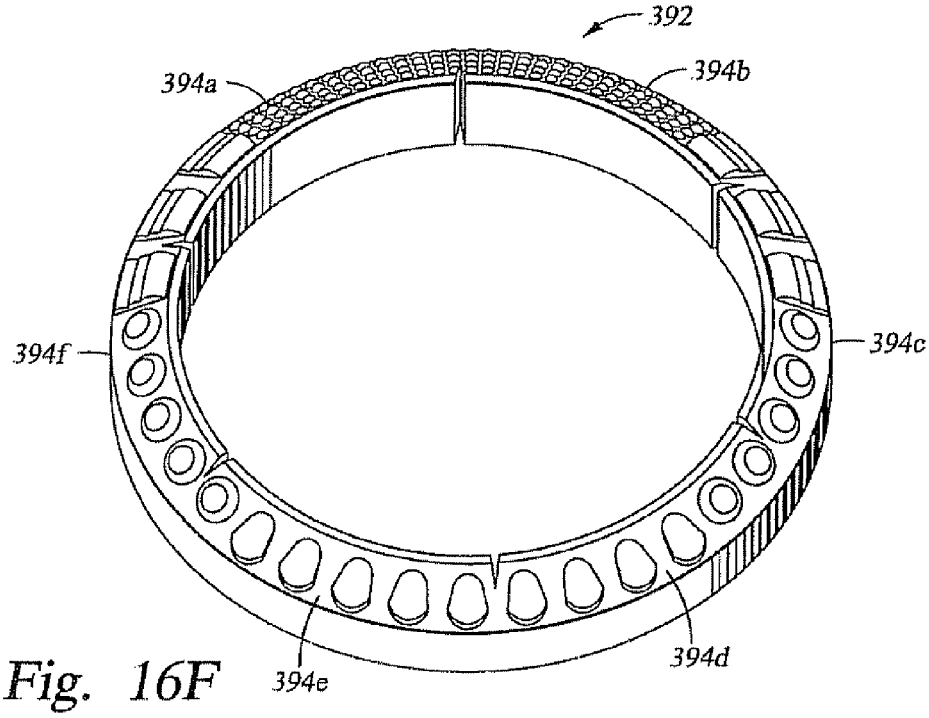

Additionally, the cutting surfaces of the arcuate and ring shaped inserts may be manufactured by creating recesses or notches in the cutting surface to form the cutting edges. One such surface, cutting surface 108, was previously described with reference to FIGS. 3-5 as including a variety of grooves and notches. Similarly, referring to FIG. 16E, depressions or recesses in the shape of circles 387, half moons 388, 389 and bow ties 390 can be employed on the cutting surface of ring shaped and arcuate inserts. An entire cutting surface maybe made having a single type of recess or, alternatively, as shown in FIG. 16E, the type of recesses may be varied or alternated along the various arcuate segments. Likewise, desired combinations of protrusions can be employed as a cutting surface. For example, ring-shaped insert 392 of FIG. 16F includes arcuate inserts 394*a-f* having a variety of protrusions, including inserts 394*a, b*, and *f* having generally rectangular protrusions, inserts 394*c, d, f* having hemispherical protrusions with flattened centers, inserts 394*d*, and *e* having wedge shaped protrusions, and inserts 394*a, b* having rows of dome-shaped protrusions.

As will be understood, the present teaching allows tremendous flexibility in the design and manufacture of rolling cone cutters and arcuate inserts for those cutters that are particularly suited for a given duty. Depending on the formation expected to be encountered, the size of the bit, the duration with which the bit is expected to perform, and the location in the rolling cone cutter where the arcuate inserts are disposed, a myriad of advantageous arcuate inserts can be employed.

Figure 17A:
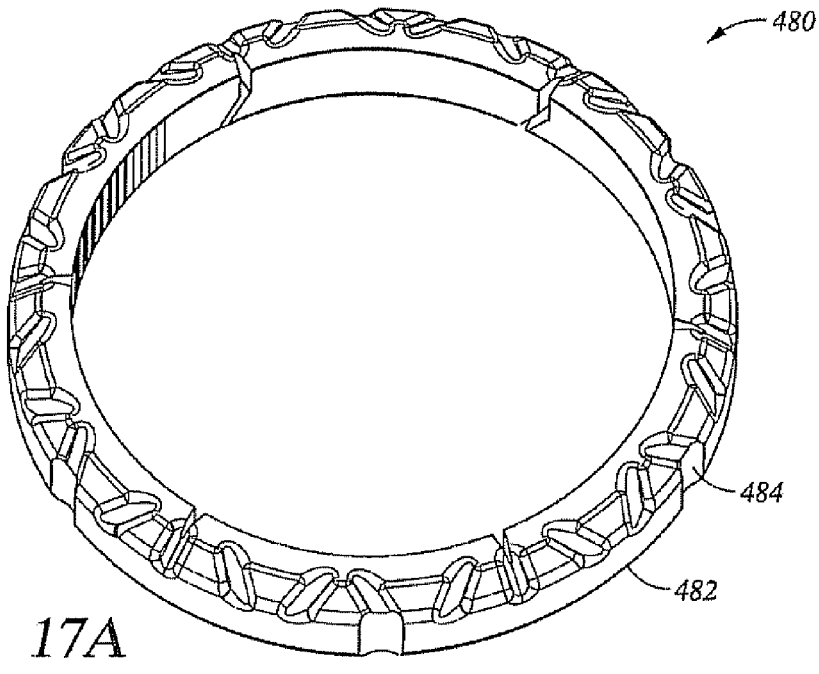
FIGS. 17A-17G are perspective views of alternative embodiments of the present invention having anti-rotational features.
Figure 17B:
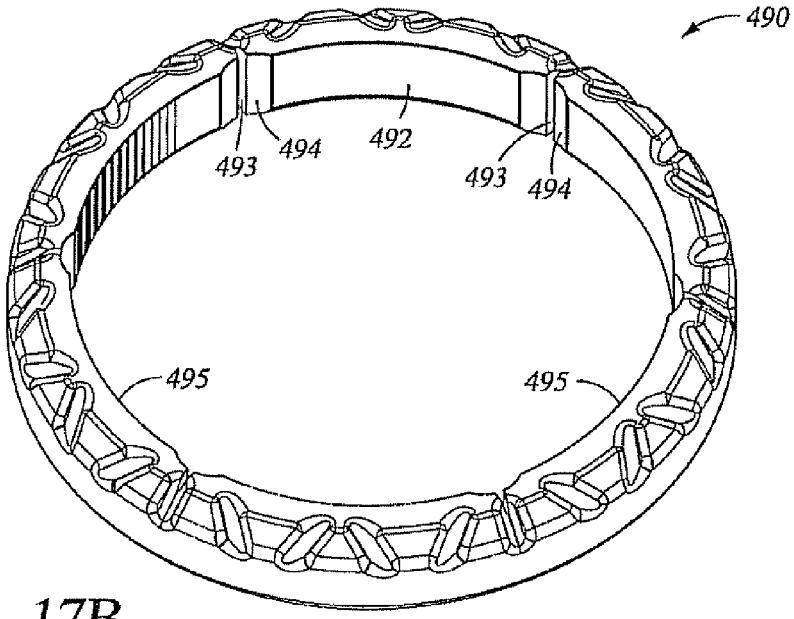
Figure 24:
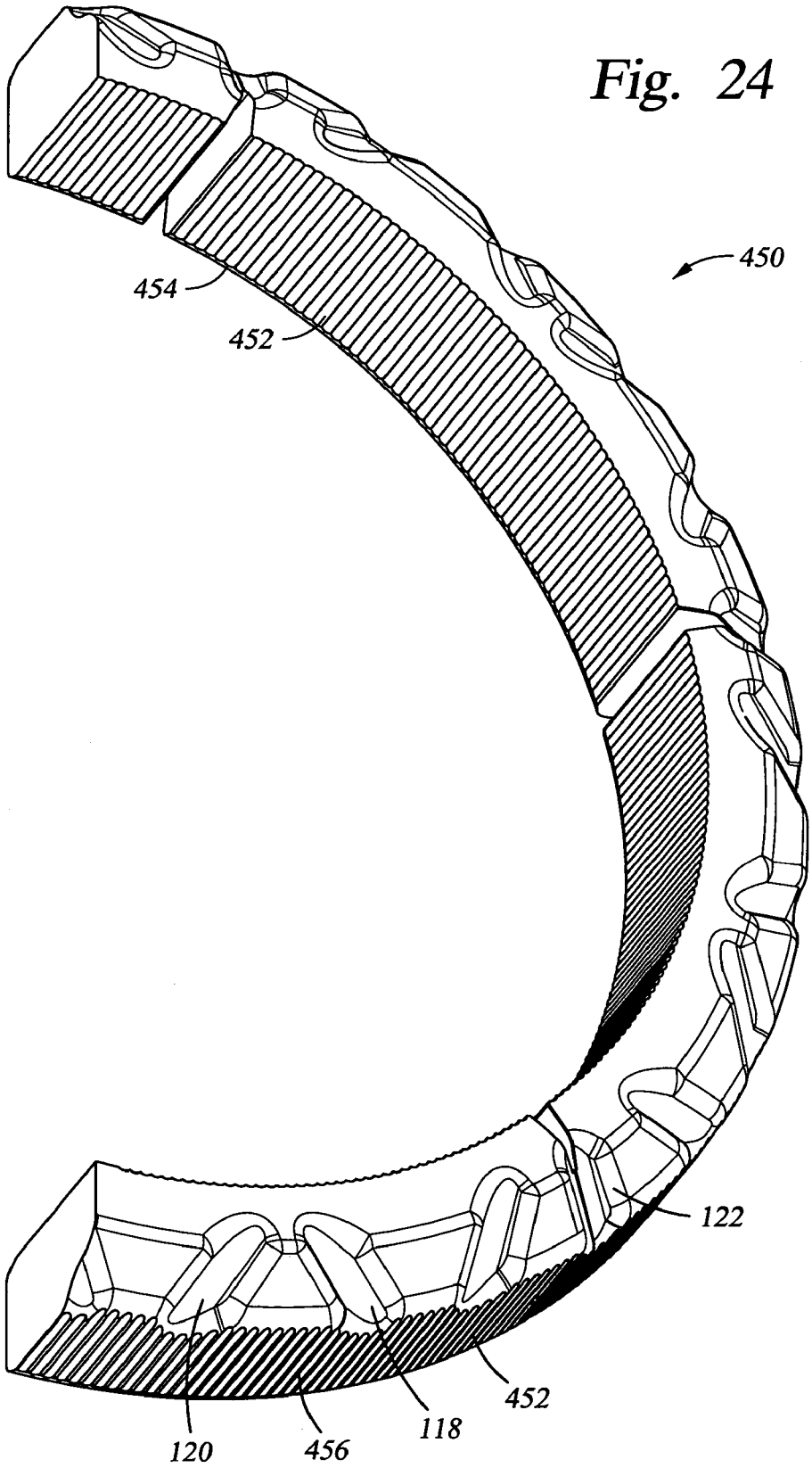
FIG. 24 is a perspective view of another alternative embodiment of the present invention.

Referring again to FIG. 24, once press fit into groove 52, the arcuate inserts 100 will normally be so tightly retained that rotational movement of the inserts 100 within groove 52 is prevented. Nevertheless, to enhance the resistance to rotational movement of the arcuate inserts described herein, additional features may be employed. For example, referring first to FIG. 17A, cut outs or concavities 484 may be formed on the outer surface 482 of a ring shaped insert 480. Although not shown, the groove into which ring shaped insert 480 is fitted will be made to include corresponding projections or pins that engage the concavities 484 so as to prevent rotation of the arcuate segments that are formed when ring insert 480 is press fitted into the cone cutter. Similarly, referring to FIG. 17B, indentations or concavities 494 are formed on the inner surface 492 of ring shaped insert 490. In this embodiment, concavities 494 are formed at the same angular position as the stress relief discontinuities 493. Concavities 494 are sized and positioned to engage corresponding protrusions formed in the groove of a cone cutter into which ring shaped insert 490 is fitted. The engagement of such concavities 494 with the protrusions formed in the cone groove will prevent rotation of the individual arcuate inserts 495 that are formed when ring 490 is fitted into the cone groove.

Figure 17C:
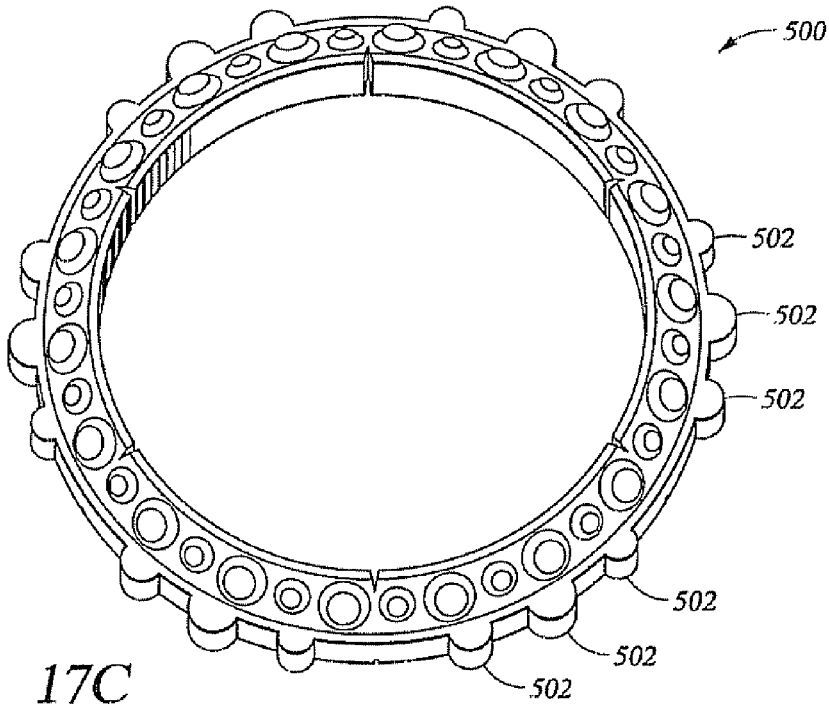
Figure 17D:
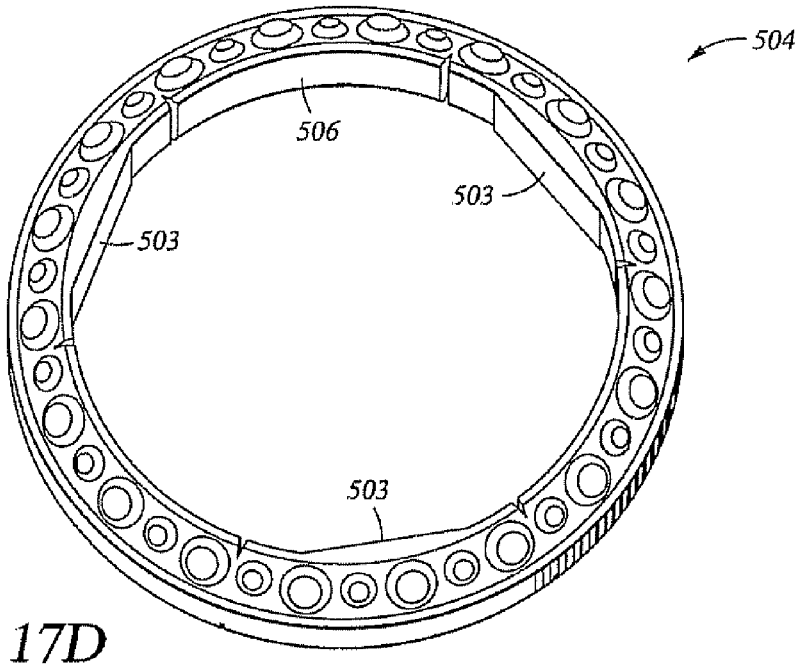
Figure 17E:
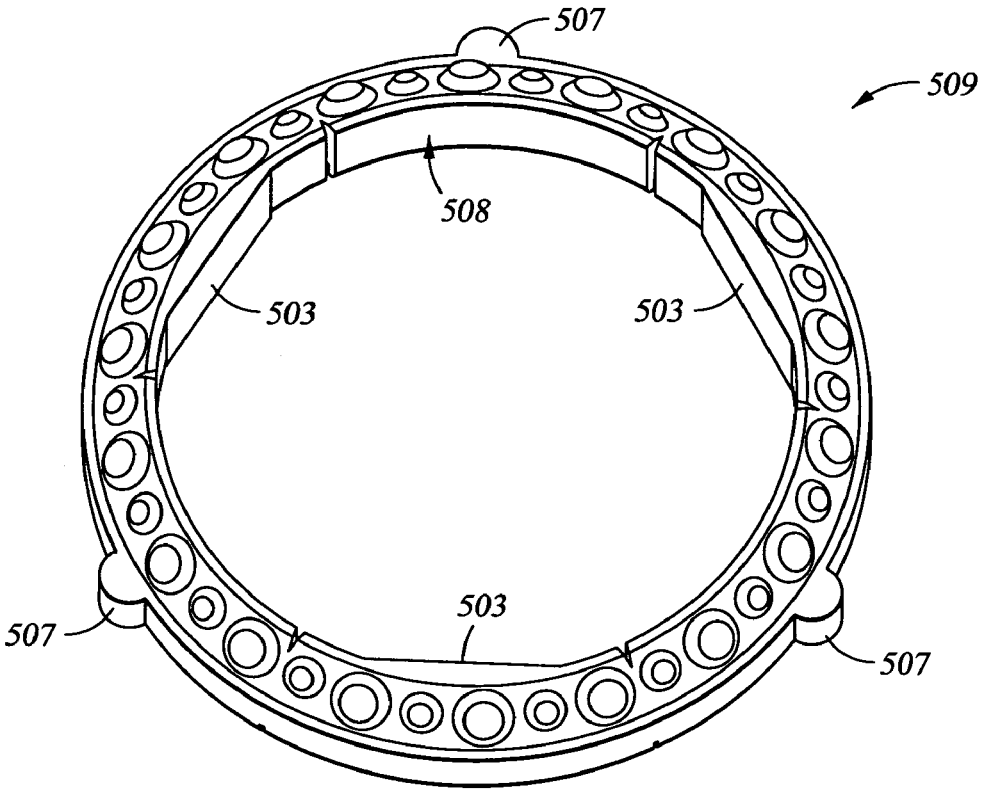

A variety of additional anti-rotational features may be employed, such as outwardly extending tabs 502 on insert 500 as shown in FIG. 17C, flats 503 forming a non-circular inner surface 506 for ring shaped insert 504 as shown in FIG. 17D, a combination of extending tabs 507 and a non-circular inner surface 508 as shown in ring-shaped insert 509 of FIG. 17E.

Figure 17F:
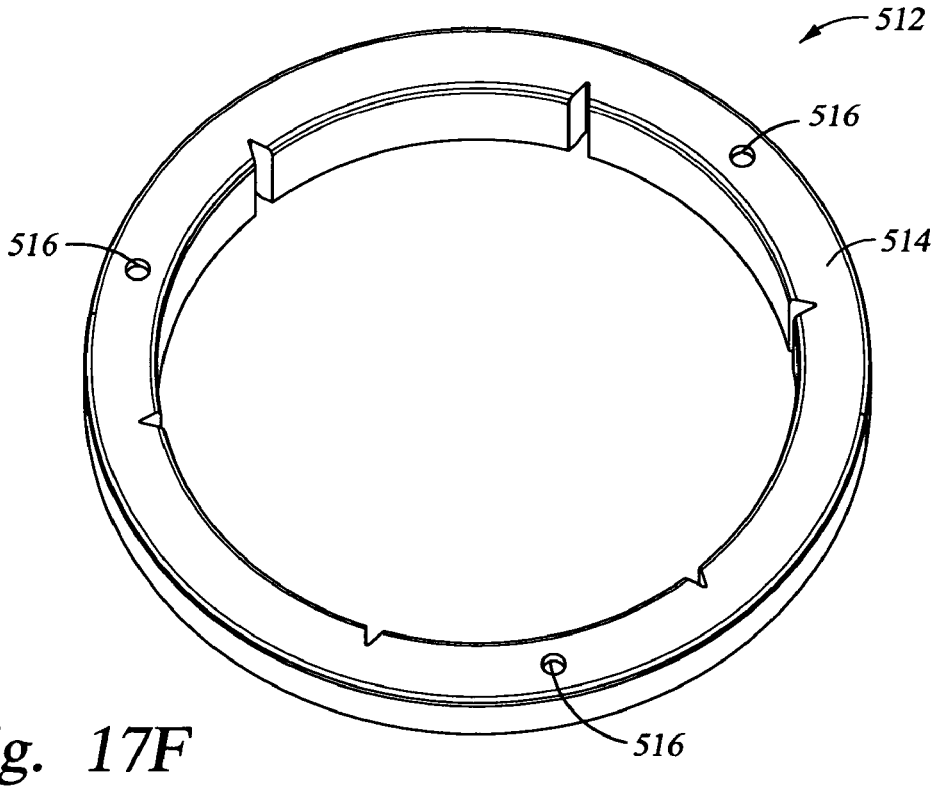
Figure 17G:
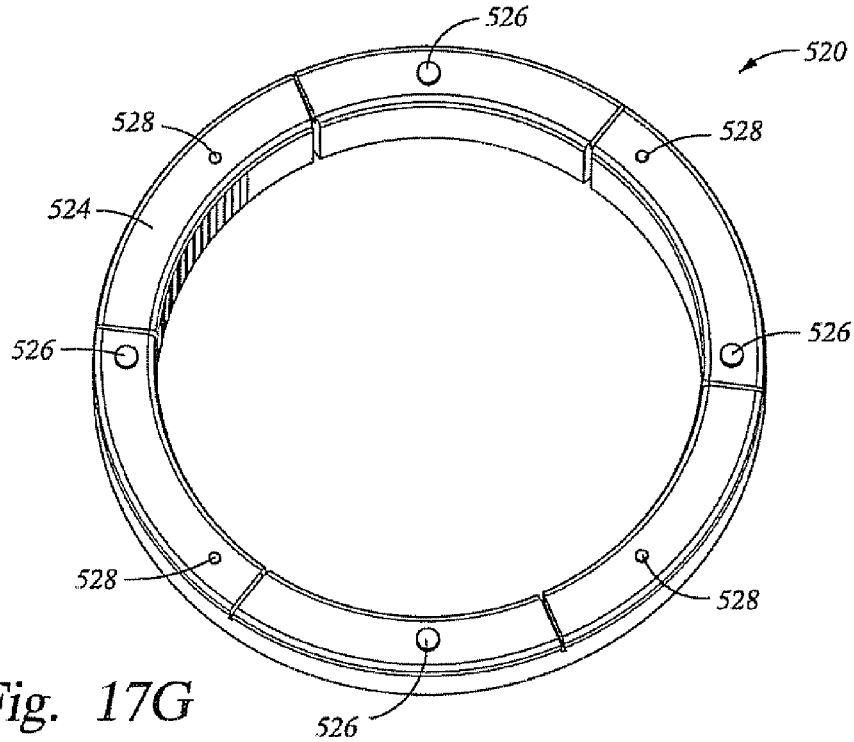

As an alternative to providing the anti-rotation features on the inner or outer surfaces of the arcuate inserts, such features may be included on the bottom surface of the insert. For example, referring to FIG. 17F, a ring shaped insert 512 is shown having a bottom surface 514. The surface 514 is formed with intention or holes 516 for receiving corresponding projections or pegs extending from the bottom of the groove that is formed in the cone material. The projection will engage the hole 516 in the bottom surface of the ring shaped insert and prevent rotation of the arcuate segments that are formed when the ring shaped insert is press fitted into a groove. A similar embodiment is shown in FIG. 17G in which the lower surface 524 of the ring shaped insert 520 includes cylindrical projections or pegs 526 that are received in depressions or holes formed in the bottom of the cone groove. In the embodiment shown in FIG. 17G, the lower surface 524 of the ring shaped insert 520 may also include holes 528 for receiving corresponding extensions extending from the cone groove.

Figure 18:
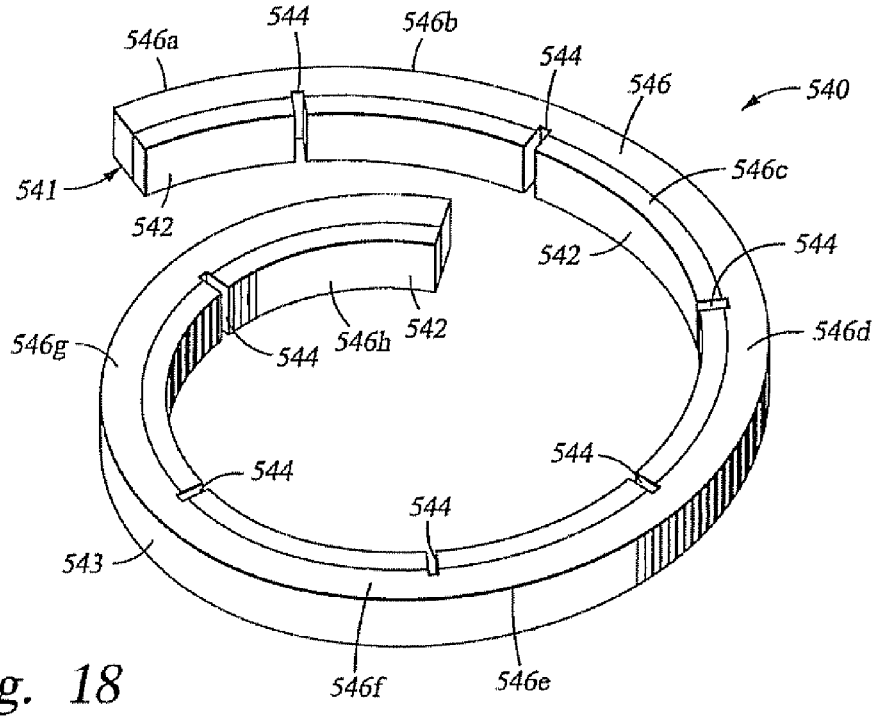
FIG. 18 is a perspective view of still another embodiment of the present invention.

Referring now to FIG. 18, a further embodiment of the invention is shown in which a spiral-shaped or coiled insert 540 is formed and preferably pressed fit into a correspondingly shaped channel or groove formed in the surface of a rolling cone cutter. More specifically, spiral insert 540 includes a coil 542 having a generally uniform cross-section along its length. In this embodiment, coil 542 includes a bottom surface 541, side surfaces 542, 543, cutting surfaces 546 and spaced apart stress relief discontinuities 544. Stress relief discontinuities are formed along side surface 542. Cutting surface 546 may include a cutting surface such as any of those previously described, including those formed by various grooves, channels, indentations, protrusions, or combinations thereof. Coil 542 may be formed by various conventional processes, such as an HIP process. When spiral-shaped insert 540 is pressed fit into the channel formed in the cone surface, or at least upon commencement of drilling with the bit having a spiral insert 540 inserted into a cone, coil 542 is permitted to fracture at the predetermined stress relief discontinuities 544, forming arcuate inserts 546*a-h*. The use of the spiral-shaped insert 540 in a corresponding spiral-shaped channel in the cone material will, like other techniques previously described herein, prevent sliding or rotational movement of the various arcuate inserts.

It is to be understood that the arcuate inserts contemplated as preferred embodiments of the invention include inserts that do not completely encircle or ring a cone cutter, although 360° coverage of a cone cutter is most preferred. For example, referring to FIGS. 16A-16D, it will sometimes be desirable to form arcuate inserts of, for example, 180 degree arcs and to insert those at various locations in the surfaces of rolling cone cutters. As a further example, three arcuate-shaped inserts corresponding to angles of 90 degrees each may, in some applications, be sufficient to provide the desired cutting action and cone life enhancement without necessitating inserting a full 360° ring-shaped insert. As with the 360° ring-shaped inserts, however, the arcuate inserts of less than 360° lengths may be formed using a conventional process, such as an HIP process, and may be formed with or without stress relieving discontinuities formed along their arcuate length. As such, the arcuate inserts of FIGS. 16A-16D are shown as examples, and employ various stress relief discontinuities about their surfaces.

The ring and other arcuate shaped inserts discussed above are designed to be press fit into a groove that is oriented generally parallel to the cone axis, such that the "depth" of the groove may be said to likewise extend in a direction generally parallel to the cone axis. For example, the sides 53,54 and the depth of retaining groove 52 of FIG. 2 extend generally parallel to cone axis 22. Likewise, the sides 173, 175 and the depth of groove 174 retaining insert 172 in FIG. 7 extend substantially parallel to cone axis 22. In these examples, arcuate inserts 100 (FIG. 2) and 172 (FIG. 7) are press fit into their respective retaining grooves in a direction substantially parallel to the cone axis.

Figure 19:
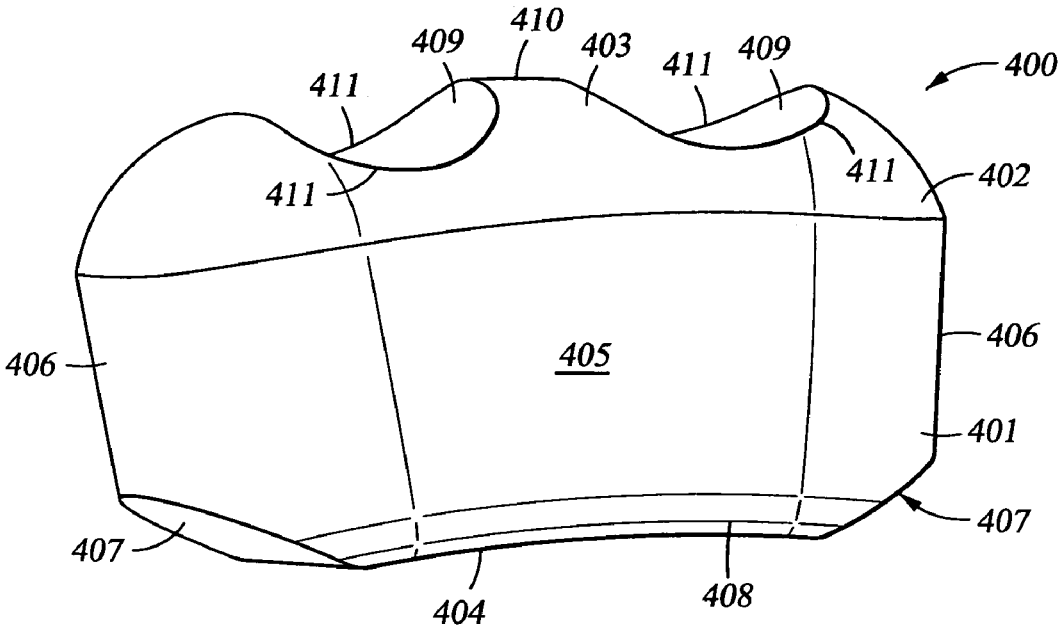
FIG. 19 is a perspective view of another alternative embodiment of the invention.
Figure 19A:
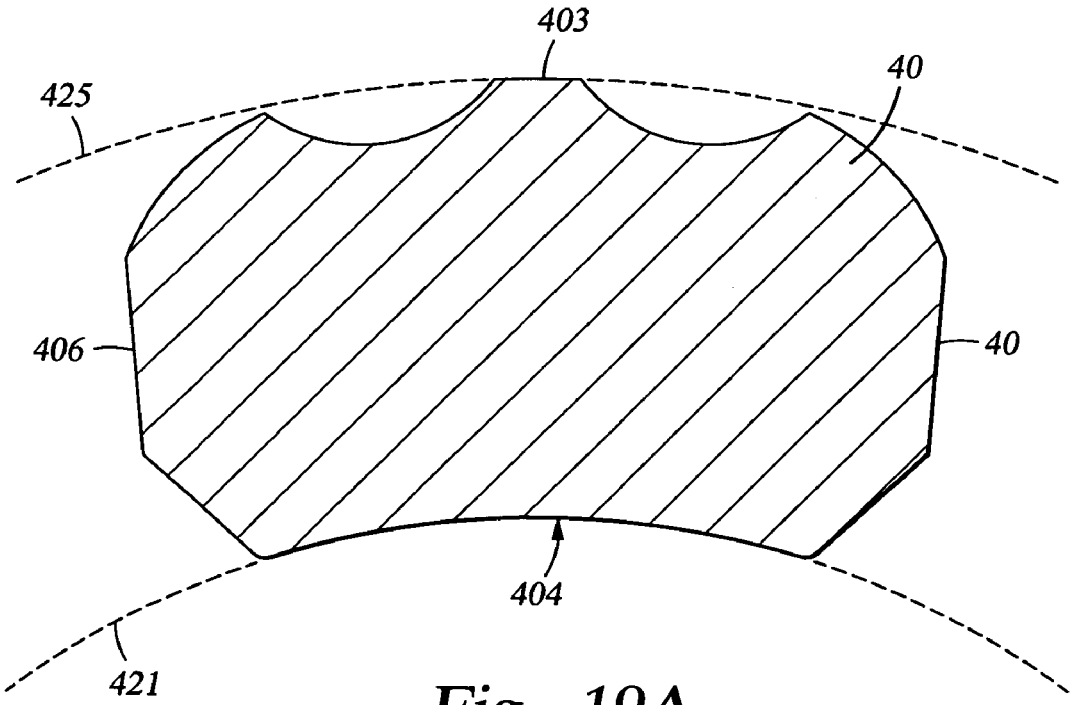
FIG. 19A is an elevation view of the arcuate insert of FIG. 19.
Figure 21:
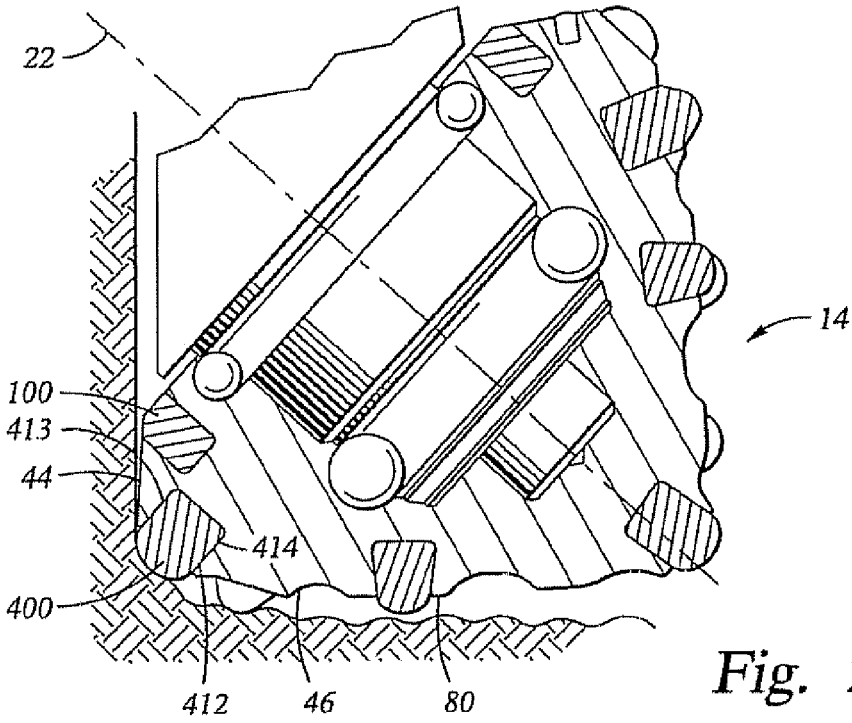
FIG. 21 is a partial section view taken through the cone cutter of FIG. 20.

Certain embodiments of the present invention may also be formed so as to be disposed and press fit into a groove or channel whose depth and sides extend in a direction that is not parallel to the cone axis and may be, for example, substantially perpendicular to the cone axis. Referring to FIGS. 19 and 19A, an arcuate insert 400 is shown having a base portion 401 and a cutting portion 402 with a cutting surface 403. The base portion generally includes an arcuate base surface 404, a pair of generally planar side surfaces 405 that are substantially parallel to one another, and a pair of rounded ends 406. Base surface 404 is generally flat when viewed in cross section as shown in FIG. 21, but extends between ends 406 as an arcuate, non-planar surface along arcuate path 421 shown in FIG. 19A. Likewise, although cutting surface 403 includes grooves, protrubences, depressions and other surface irregularities designed to cut formation material, surface 403 likewise extends between ends 406 in a generally arcuate surface as represented by arcuate path 425 shown in FIG. 19*a*. The ends include a chamfered portion 407 and the intersection of sides surfaces and the bottom surface are rounded slightly at their intersection as shown at 408. The cutting surface 403, in this embodiment, includes a pair of recesses 409 forming a raised portion 410 therebetween and cutting edges 411.

Figure 20:
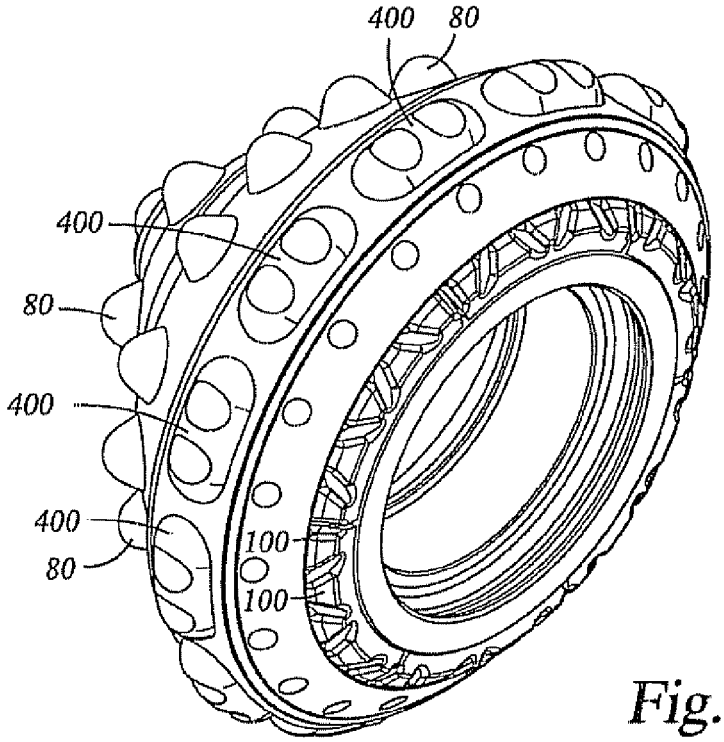
FIG. 20 is a perspective view of the arcuate insert shown in FIG. 19 installed in a cone cutter of a rolling cone bit.

Referring to FIGS. 20 and 21, a plurality of inserts 400 are press fit, end to end, in retaining groove 412 that generally is formed between heel surface 44 and the conical surface 46 that retains the inner row inserts 80. Arcuate inserts 400 thus form gage row cutters that are designed and positioned on the cone 14 for cutting the borehole corner. Retaining groove 412 includes sides 413,414 that extend generally perpendicular to the cone axis 22 as best shown in FIG. 21. In this manner, groove 412 may be said to have a depth that extends in a direction that is not parallel to the cone axis 22 and, in this particular embodiment, is substantially perpendicular to the cone axis 22. As shown in FIGS. 20 and 21, cone 14 may also be configured and include a plurality of arcuate inserts 100 as previously described to protect the backface and/or heel surfaces of the bit. As will be apparent, because the groove 412 is generally perpendicular to the cone axis 22, arcuate inserts 400 may not be press fit into groove 412 as a complete ring, but instead must be press fit as individual inserts, or press fit as arcuate inserts having arcuate lengths less than 360° that fragment at stress relief discontinuities into separate inserts.

Figure 22:
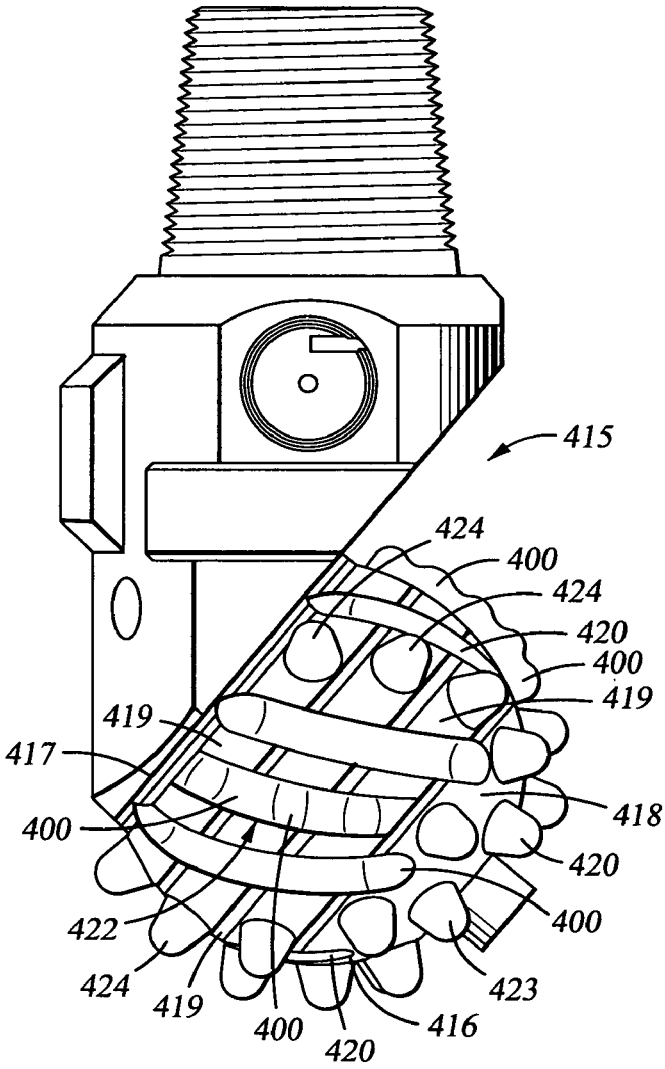
FIGS. 22 and 23 are perspective views of still additional embodiments of the present invention as employed in a single cone bit.

The arcuate inserts described herein have application beyond use in multicone drill bits. For example, and referring to FIG. 22, there is shown a single cone, rolling cone bit 415 having a single cone cutter 416. The single cone 416 generally includes a generally planar backface 417 and a generally spherical surface 418 that retains a plurality of cutting elements that are press fit into the spherical surface 418. The spherical surface in this embodiment is generally divided into blades 419 that are separated by grooves 420. The cutting elements include a plurality of arcuate inserts, such as inserts 400, that are press fit and retained in grooves 422 formed in spherical surface 418. Each groove 422 extends generally along the length of a blade 419. In the embodiment shown in FIG. 22, every other blade includes rows of inserts 400 disposed end-to-end in a groove 422, with conventional cylindrical inserts 424 retained in the intermediate blades. In other embodiments, all blades or a fewer number of blades, retain arcuate inserts 400.

Figure 23:
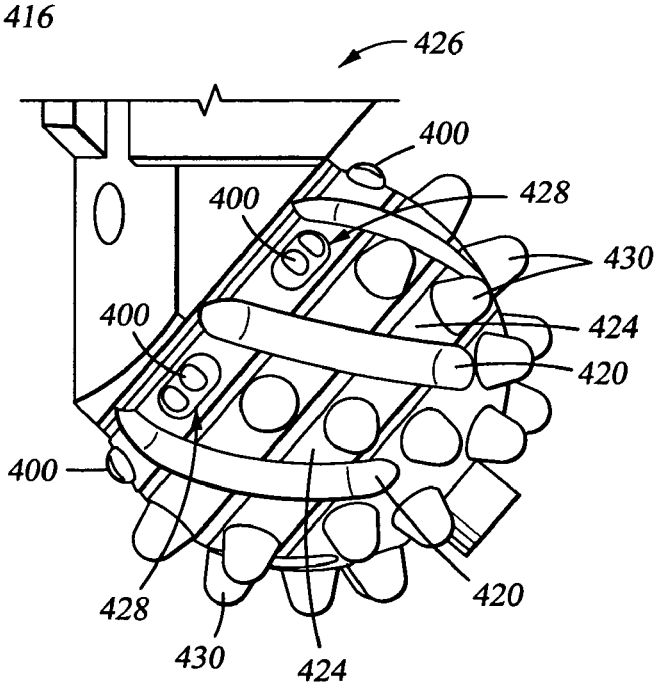

Referring now to FIG. 23, the spherical surface 424 of a single cone bit 426 includes a circumferential row of gage cutters and a plurality of circumferential rows of inner row cutters 430. As shown, gage row cutters are arcuate inserts 400 as previous described that are press fit into a groove 428 formed in the spherical surface 424. As shown in FIG. 23, a single arcuate insert 400 is press fit into groove 428 formed in each blade (between grooves 420). In other instances, it may be desirable to include two or more arcuate inserts 400 in a blade 419.

To ensure that the arcuate inserts described herein are securely gripped and thus properly retained in the retaining groove, the inner or outer side surfaces of the arcuate inserts, or both surfaces, may be manufactured so as to have grooved, scored, ridged or otherwise knurled surfaces. For example, and referring momentarily to FIG. 24, an arcuate insert 450 having an arcuate length of 180 degrees is shown to include knurls 452 on the inner and outer surface for enhanced gripping. In the embodiment shown, the knurls 452 on inner surface are parallel ridges 454 that extend the entire height of the side surface, while the knurls 452 on the outer surface are parallel grooves 456 that extend up the side, but stop short of intersecting grooves 118, 120, 122 on the cutting surface.

The arcuate inserts described herein have application in drill bits beyond their use in rolling cone cutters. For example, the arcuate inserts described herein may be employed in the cutting surfaces of fixed blade or "drag bits." Likewise, in some applications in the past, conventional, cylindrical inserts were sometimes placed in the body of a drill bit about or in close proximity to nozzles, lubricant reservoirs or other bit features deserving of additional protection. The arcuate inserts described herein may be employed to protect such structures. For example, referring to FIG. 1, arcuate inserts 100 are shown press fit in a retaining groove 460 formed partially about lubricant reservoir 17. Alternatively, a ring shaped insert 130 may be press fit into such a groove that is formed in the bit body and that encircles the reservoir 17. Upon being press fit into the groove, the stress relief discontinuities of ring 130 will allow the ring to fragment at predetermined locations so as to form a plurality of arcuate inserts 100 in an end-to-end relationship within the groove. Similarly, arcuate inserts such as inserts 100 may be located in the shirttail or elsewhere in the bit legs or bit body to provide protection from wear.

Various embodiments of the invention include ring-shaped inserts having 360° arcuate lengths and that may be formed without the previously-described stress relief discontinuities. In general, depending upon the bit size, the weight-on-bit, the formation being drilled and other variables, the ring-shaped inserts previously described with reference to FIGS. 4, 6, 9-18, for example, may be formed without stress relief discontinuities. In such embodiments, the 360° ring is press fit into the cone's receiving groove and retained by interference fit. The ring may fracture at one or more locations along its arcuate length due the stresses induced in the ring during manufacture or use. Nevertheless, without regard to whether stress-induced fractures occur, the ring-shaped insert may be retained within the circumferential groove in the cone and provide many of the advantages of the arcuate-shaped inserts previously described.

Figure 25:
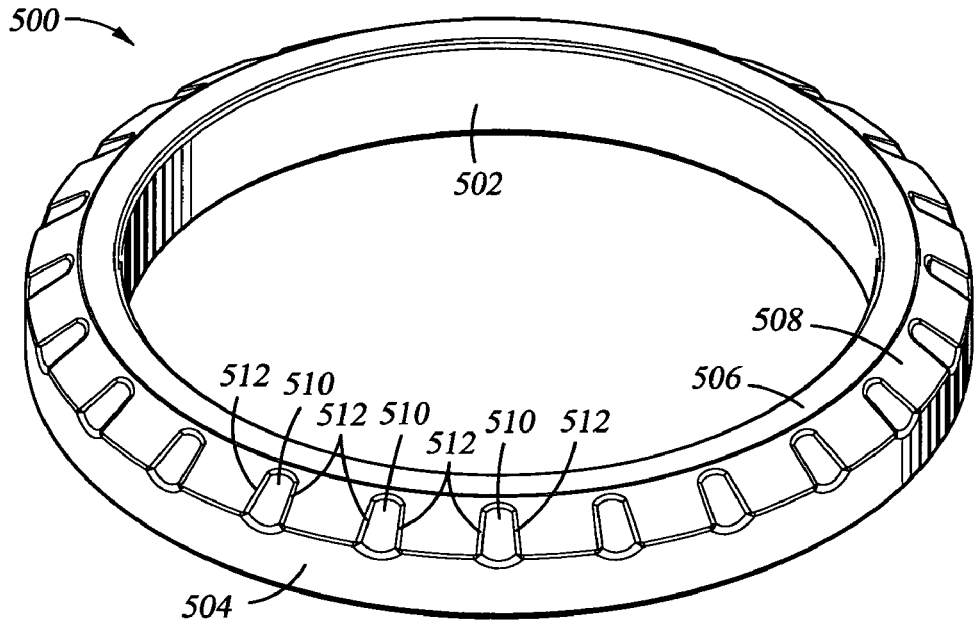
FIG. 25 is a perspective view of another alternative embodiment of the invention, a ring-shaped insert suitable for use in a rolling cone cutter of a drill bit, such as that shown in FIG. 2.

More specifically, referring to FIG. 25, a 360° ring-shaped insert 500 is shown and is suitable for being press fit and retained in a cone groove, such as groove 52 of cone 14 shown in FIG. 2. In this embodiment, ring-shaped insert 500 includes circumferential inner and outer surfaces 502, 504, respectively. Surfaces 502, 504 are generally concentric and, when viewed in cross-section, are substantially parallel. Surfaces 502, 504 engage the corresponding side surfaces of the retaining groove 52. Ring-shaped insert 500 further includes an annular surface 506 and a generally frustoconical cutting surface 508. When inserted in groove 52 of cone 14 shown in FIG. 2, surface 506 is generally co-planar with backface 40 and surface 508 generally extends above the cone's heel surface 44 to provide certain cutting action on the borehole wall. As shown in FIG. 25, cutting surface 508 includes a plurality of generally radially-oriented grooves 510 forming cutting edges 512. In this embodiment, grooves 510 extend along surface 508, but do not extend into the annular surface 506. As shown in FIG. 25, ring-shaped insert 500 is formed without the stress relief discontinuities described with respect to previous embodiments herein, although it is understood that the grooves 510 themselves provide some reduction of stress along surface 508 and, should ring 500 fracture upon assembly into cone 14 or upon use, a fracture may indeed occur along one or more of the grooves 510.

The 360° arcuate inserts formed without stress relief discontinuities may be made having various cross-sectional shapes, such as any of those previously described with reference to FIG. 8A-8H. Likewise, the 360° arcuate inserts may be made of multiple materials portions or layers, such as any of those shown in FIGS. 13A-13H, as examples. Further, the ring-shaped inserts formed without stress relief discontinuities may include any of the previously described anti-rotational features, including any of those shown and described with reference to FIGS. 17A-17G, in any combination.

Figure 26:
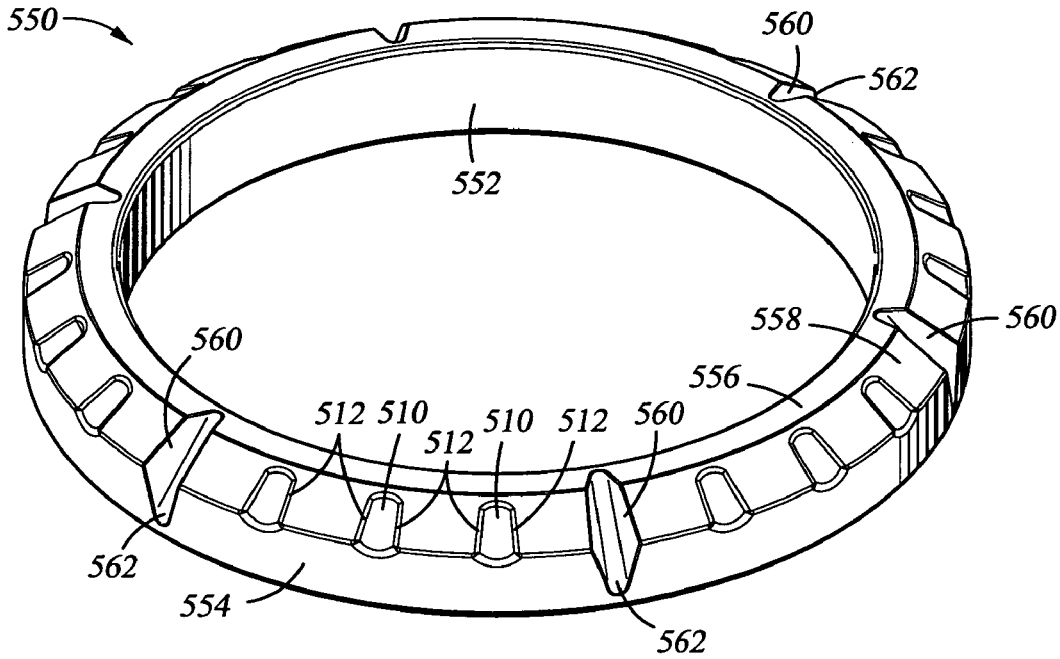
FIG. 26 is a perspective view of another alternative embodiment of the present invention.

Referring now to FIG. 26, another alternative embodiment is depicted in which the 360° ring-shaped arcuate insert 550 is shown. Ring 550 is substantially similar to ring-shaped insert 500 shown in FIG. 25, and includes grooves 510 forming cutting edges 512 as previously described. Additionally, ring-shaped insert 550 includes stress relief discontinuities 560 which, in this embodiment, are formed by radially-aligned grooves 562 formed in frustoconical surface 558 and extending into annular surface 556 and outer cylindrical surface 554. In this embodiment, it is preferred that grooves 562 forming stress relief discontinuities 560 be deeper than grooves 510 forming cutting edges 512. When ring 550 is press fit into a rolling cone cutter, such as cone cutter 14 of FIG. 2, ring insert 550 may fracture at one or more stress relief discontinuities 560. Likewise, depending upon the application, loading, and other factors, fracture of ring insert 550 may occur during use of the bit. Alternatively, ring-shaped insert 550 may withstand the imparted forces and stresses and remain intact as a 360° arcuate insert.

Figure 27:
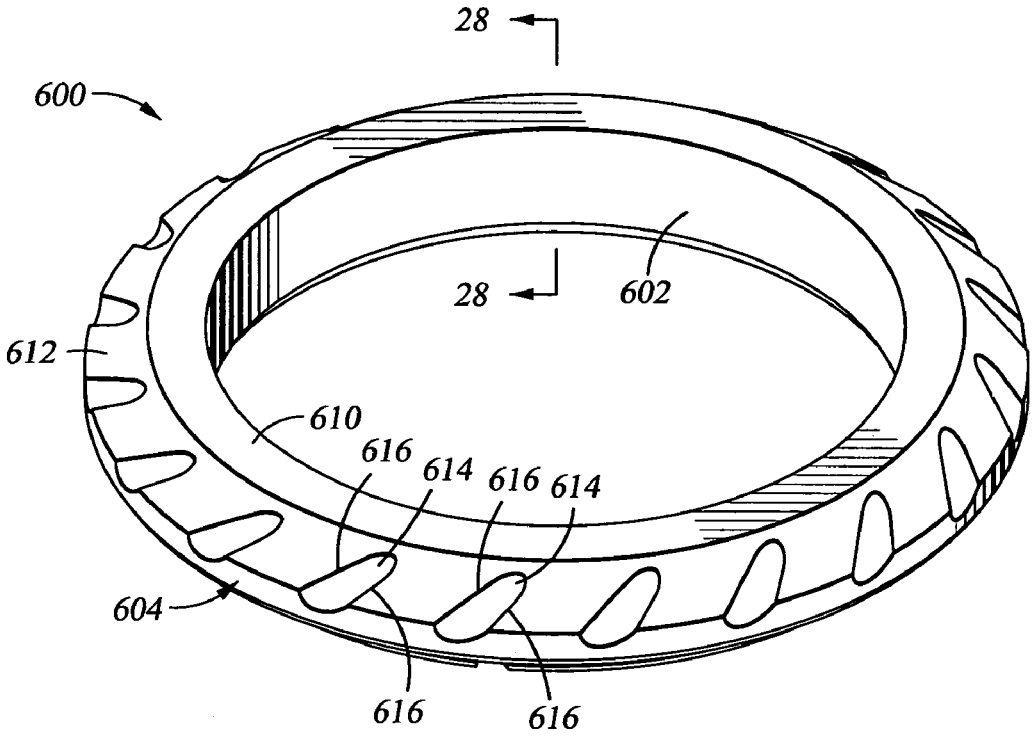
FIG. 27 is a perspective view of still another alternative embodiment of the present invention.
Figure 28:
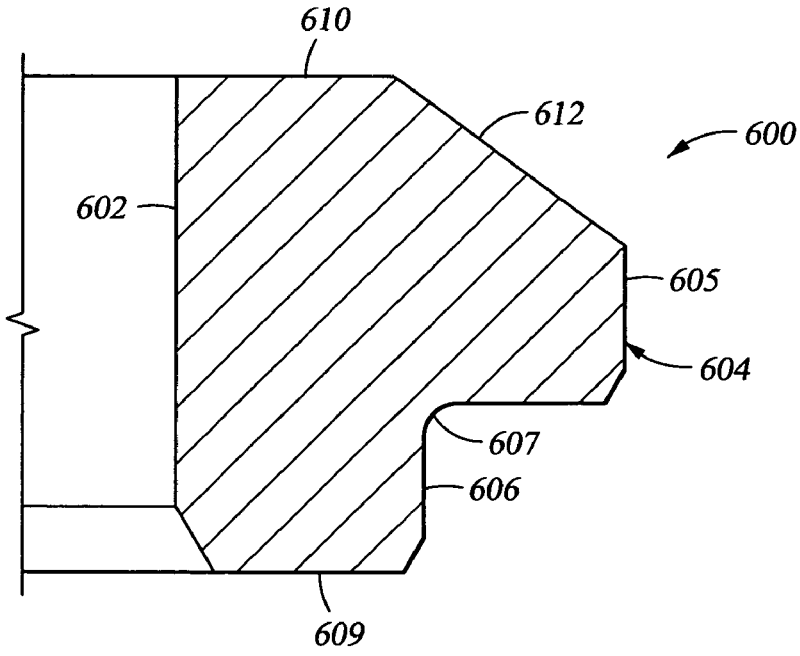
FIG. 28 is a cross-sectional view of the ring-shaped insert of FIG. 27.

Another embodiment of a ring-shaped insert having 360° arcuate length is shown in FIGS. 27 and 28. As shown therein, ring-shaped insert 600 includes an inner cylindrical surface 602 and an outer surface 604. As best shown in FIG. 28, outer surface 604 includes generally cylindrical surfaces 605 and 606 that are substantially concentric and joined by curved intersecting surface 607. Adjacent to inner surface 602 is a generally planar annular surface 610. A generally frustoconical surface 612 extends between surface 610 and surface 605. Bottom surface 609 extends between inner surface 602 and surface 606. As best shown in FIG. 27, surface 612 includes grooves 614 formed therein which create cutting edges 616. In this embodiment, grooves 614 are generally oriented so as to create cutting edges 616 having negative backrake angles. It is intended that ring 600 be press fit into a groove in a cone cutter, such as groove 52 in cone cutter 14 as previously described with reference to FIG. 2. In such an application, ring-shaped insert 600 is disposed in groove 52 to a depth such that annular surface 610 is generally co-planar with backface 40 and frustoconical surface 612 generally extends above cone heel surface 44 to provide certain cutting action on the borehole wall. The cutting surface created by grooves 614 thus provides cutting and reaming capabilities, while surface 612, in its entirety, serves to ensure that the bit retains its ability to cut a full gage diameter borehole.

Figure 29:
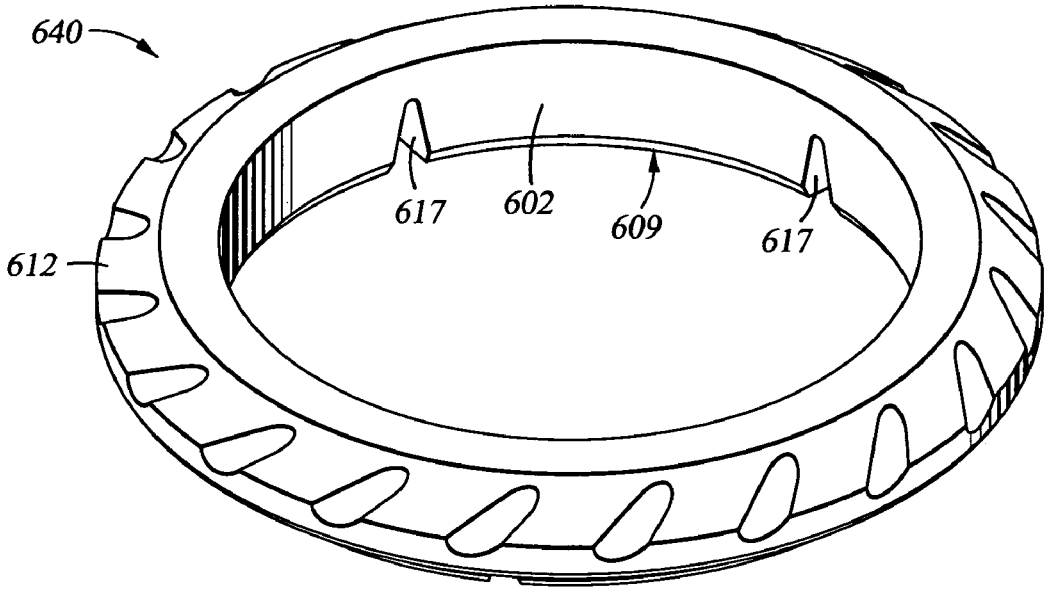
FIGS. 29 and 30 are similar to FIG. 25 and are perspective views of still further alternative embodiments of the present invention.

In certain applications, the strength of ring 600 will be great enough such that the stresses imparted to the ring upon assembly and use while drilling will not cause fracture of the ring. Accordingly, as shown in FIG. 27, ring-shaped insert 600 may be made without stress relief discontinuities. Alternatively, in an application where it is desired that ring 600 fracture into arcuate-shaped inserts of predetermined arcuate length, or where it is anticipated that the ring may fracture, stress relief discontinuities may be provided. For example, as shown in FIG. 29, a ring-shaped insert 640 is shown to include stress relief discontinuities formed by grooves 617. Grooves 617 are formed when ring-shaped insert 640 is initially formed (such as in an HIP process) or may be machined into the ring thereafter. In this example, the grooves 617 are formed in the base portion of insert 640, such grooves extending along bottom surface 609. Alternatively, any of the other types of stress relief discontinuities previously described herein may be employed with ring 640, including, as a further example, grooves that are formed in surface 612, such as grooves 560 previously described with reference to FIG. 26.

Figure 30:
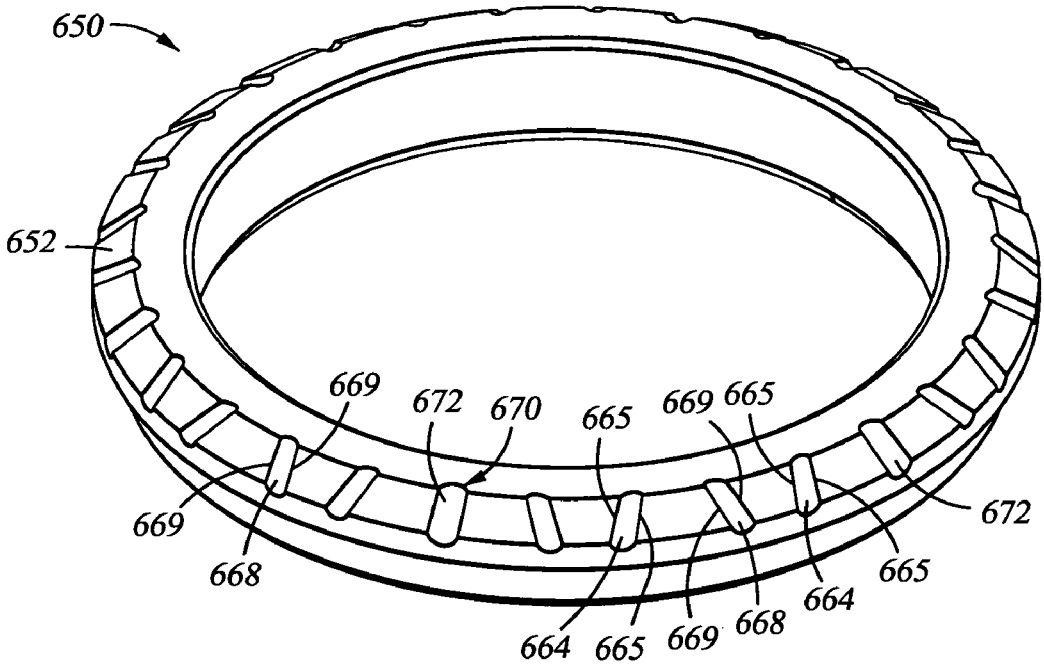

Referring to FIG. 30, a still further alternative embodiment is shown to include a ring-shaped insert 650 that is similar to ring 600 previously described with reference to FIGS. 27-28. In this embodiment, ring 650 has the same general cross-section as ring 600; however, cutting surface 652 of ring 650 includes grooves 664 and 668 which form cutting edges 665, 669 respectively. Cutting edges 665 are formed having negative back rake angles, with cutting edges 669 having positive backrake angles. In this embodiment, ring-shaped 650 further includes stress relief discontinuities 670 formed by grooves 672 that are spaced about surface 652 and oriented to extend generally radially. Once again, depending on the application, ring 650 may include other types of stress relief discontinuities formed in other surfaces of ring 650, or ring 650 may be formed without such stress relief discontinuities of any type.

While various preferred embodiments of the invention have been showed and described, modifications thereof can be made by one skilled in the art without departing from the spirit and teachings of the invention. The embodiments herein are exemplary only, and are not limiting. Many variations and modifications of the invention and apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A bit for drilling a borehole into earthen formations, the bit comprising:

a bit body;

a rolling cone cutter mounted on said bit body and being adapted to rotate about a cone axis;

a circumferential groove formed in said cone cutter;

a ring-shaped insert having a 360° arcuate length retained by interference fit within said groove, wherein said ring-shaped insert includes a pair of side surfaces and a cutting surface extending between said side surfaces, said cutting surface including cutting edges.

2. The drill bit of claim 1 further comprising grooves in said cutting surface, said grooves forming said cutting edges.

3. The drill bit of claim 2 wherein said cone cutter includes a cone surface, and wherein said circumferential groove extends into said cone surface a predetermined depth; and wherein said insert is retained in said groove such that said cutting surface extends above said cone surface.

4. The drill bit of claim 1 wherein said ring-shaped insert comprises at least one stress relief discontinuity.

5. The drill bit of claim 4 wherein said stress relief discontinuity is disposed at least partially in said cutting surface.

6. The drill bit of claim 4 wherein said insert includes a bottom surface, and wherein said stress relief discontinuity is disposed at least partially in said bottom surface.

7. The drill bit of claim 1 wherein said cutting edges have negative backrake angles.

8. The drill bit of claim 1 wherein a first plurality of said cutting edges have negative backrake angles and a second plurality of said cutting edges have positive backrake angles.

9. A bit for drilling a borehole into earthen formations, the bit comprising;

a bit body;

a rolling cone cutter rotatably mounted on said bit body and being adapted to rotate about a cone axis;

a groove formed in said cone cutter arid extending completely around said cone axis;

a ring-shaped insert having a 360° arcuate length, said insert having a radially innermost side surface, a radially outermost side surface, and a cutting surface extending between said side surfaces, said cutting surface including a plurality of cutting edges.

10. The bit of claim 9 wherein said cutting surface comprises a generally frustoconical surface, and grooves formed in said frustoconical surface.

11. The bit of claim 10 wherein said cutting surface comprises a plurality of generally radially aligned grooves.

12. The bit of claim 10 wherein said cutting surface comprises a plurality of non-radially aligned grooves forming cutting edges having negative backrake angles.

13. The bit of claim 9 wherein said cutting surface comprises a plurality of protrusions.

14. The bit of claim 9 wherein said cutting surface comprises a plurality of recesses.

15. The bit of claim 9 wherein said ring-shaped insert includes at least one stress relief discontinuity.

16. A bit for drilling a borehole into earthen formations, the bit comprising;

a bit body;

a rolling cone cutter rotatably mounted on said bit body and being adapted to rotate about a cone axis;

a groove formed in said cone cutter and extending completely around said cone axis;

a ring-shaped insert having a 360° arcuate length and a cutting surface, said ring shaped insert retained in said groove;

wherein said cutting surface includes a plurality of cutting edges; and wherein said cutting surface comprises a plurality of non-radially aligned grooves forming a first plurality of cutting edges having negative backrake angles and a second plurality of cutting edges having positive backrake angles.

17. A cutter element for insertion into a cone cutter of a rolling cone drill bit, the cutter element comprising:

a ring-shaped body having an arcuate length of 360° and extending about a central axis, said body having a radially innermost side surface, a radially outermost side surface, and a cutting surface extending between said side surfaces, said cutting surface including a plurality of cutting edges.

18. The cutter element of claim 17 wherein said cutting surface comprises a generally frustoconical surface and a plurality of grooves formed in said frustoconical surface.

19. The cutter element of claim 18 wherein a first plurality of said plurality of grooves are radially aligned.

20. The cutter element of claim 18 wherein said grooves form cutting edges and wherein said cutting surface includes a first plurality of cutting edges having negative backrake angles.

21. The cutter element of claim 17 wherein said ring-shaped insert includes at least one stress relief discontinuity.

22. The cutter element of claim 21 wherein said stress relief discontinuity is formed in said cutting surface.

23. The cutler element of claim 21 further comprising a bottom surface, and wherein said stress relief discontinuity is formed in said bottom surface.

24. A cutler element for insertion into a cone cutter of a rolling cone drill bit, the cutter element comprising:

a ring-shaped body having an arcuate length of 360° and extending about a central axis, said body having a radially innermost side surface, a radially outermost side surface, and a cutting surface extending between said side surfaces, said cutting surface including a plurality of cutting edges;

wherein said cutting surface includes a first plurality of cutting edges having negative backrake angles and a second plurality of cutting edges having positive backrake angles.

25. A method for manufacturing a rolling cone drill bit comprising:

providing a rolling cone cutter having a cone axis;

forming a groove in said cone cutter;

providing a cutter insert having an arcuate-shaped base portion and a cutting portion, said cutter insert having a radially innermost side sur face, a radially outermost side surface, and a cutting surface extending between said side surfaces, said cutting surface including a plurality of cutting edges;

after providing said cutter insert having said arcuate-shaped base portion, fixing said insert into said cone cutter by press fitting said base portion into said groove.

26. The method of claim 25 further comprising:

forming a circumferential groove completely around said cone axis;

press fitting into said circumferential groove a cutter insert having a 360° arcuate length.

27. The method of claim 26 further comprising:

forming at least two circumferential grooves completely around said cone axis; and press fitting a cutter insert having a 360° arcuate length into each of said grooves.

28. The method of claim 26 wherein said cone cutter includes a backface, and wherein said groove is formed in a surface of said cone cutter other than said backface.

29. The method of claim 25 further comprising forming said cutting surface to include a plurality of cutting edges prior to press fitting said insert into said groove.

30. A method for manufacturing a drill bit comprising:

providing a rolling cone cutter having a cone axis, a backface, a generally frustoconical heel surface adjacent said backface, and a generally conical surface adjacent to said heel surface;

forming a cutter insert having a 360° arcuate length and a cutting surface that comprises a plurality of cutting edges disposed along said length;

forming a circumferential groove in said cone cutter; and after forming said cutter insert, press fitting said cutter insert into said circumferential groove.

31. A bit for drilling a borehole into earthen formations, the bit comprising;

a bit body;

a rolling cone cutter rotatably mounted on said bit body and being adapted to rotate about a cone axis;

a groove formed in said cone cutter and extending completely around said cone axis;

a ring-shaped insert having a 360° arcuate length and a cutting surface, said cutting surface including an inner annular surface, an outer annular surface, and a plurality of cutting edges extending at least partially across the inner annular surface and at least partially across the outer annular surface; and wherein the ring-shaped insert is retained by interference fit within said groove.

32. The bit of claim 31 wherein the cone cutter includes a backface and a frustoconical heel surface, said groove formed at least partially in each of the backface and the frustoconical heel surface of the cone cutter.

33. The bit of claim 32 wherein the inner annular surface of the ring-shaped insert is substantially co-planar with the backface surface of the cone cutter, and the outer annular surface is substantially co-planar with the frustoconical heel surface of the cone cutter.

34. The drill bit of claim 31 wherein said cutting edges have negative backrake angles.

35. The drill bit of claim 31 wherein a first plurality of said cutting edges have negative backrake angles and a second plurality of said cutting edges have positive backrake angles.

* * * * *